US009031256B2

(12) United States Patent
Visser et al.

(10) Patent No.: US 9,031,256 B2
(45) Date of Patent: May 12, 2015

(54) SYSTEMS, METHODS, APPARATUS, AND COMPUTER-READABLE MEDIA FOR ORIENTATION-SENSITIVE RECORDING CONTROL

(75) Inventors: Erik Visser, San Diego, CA (US); Ian Ernan Liu, San Diego, CA (US); Dinesh Ramakrishnan, San Diego, CA (US); Lae-Hoon Kim, San Diego, CA (US); Pei Xiang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 834 days.

(21) Appl. No.: 13/280,211

(22) Filed: Oct. 24, 2011

(65) Prior Publication Data

US 2012/0128175 A1 May 24, 2012

Related U.S. Application Data

(60) Provisional application No. 61/406,396, filed on Oct. 25, 2010.

(51) Int. Cl.
*H04R 3/00* (2006.01)
*H04R 1/02* (2006.01)
(Continued)

(52) U.S. Cl.
CPC ..... *H04R 3/005* (2013.01); *H04S 7/303* (2013.01); *H04R 2201/401* (2013.01); *H04R 2201/403* (2013.01); *H04R 2201/405* (2013.01); *H04R 2430/21* (2013.01); *H04R 2430/23* (2013.01)

(58) Field of Classification Search
CPC ... H04R 2201/401; H04R 1/406; H04R 3/005
USPC ..... 381/92, 306, 333, 122, 310, 17, 18
See application file for complete search history.

(56) References Cited

U.S. PATENT DOCUMENTS 5,987,142 A 11/1999 Courneau et al.
6,005,610 A 12/1999 Pingali
(Continued)

FOREIGN PATENT DOCUMENTS

CN 101133679 A 2/2008
JP 07095698 4/1995
(Continued)

OTHER PUBLICATIONS

International Search Report and Written Opinion—PCT/US2011/057730—ISA/EPO—Mar. 5, 2012.
(Continued)

*Primary Examiner* — Vivian Chin
*Assistant Examiner* — Douglas Suthers
(74) *Attorney, Agent, or Firm* — Austin Rapp & Hardman

(57) ABSTRACT

A method of orientation-sensitive recording control includes indicating, within a portable device and at a first time, that the portable device has a first orientation relative to a gravitational axis and, based on the indication, selecting a first pair among at least three microphone channels of the portable device. This method also includes indicating, within the portable device and at a second time that is different than the first time, that the portable device has a second orientation relative to the gravitational axis that is different than the first orientation and, based on the indication, selecting a second pair among the at least three microphone channels that is different than the first pair. In this method, each the at least three microphone channels is based on a signal produced by a corresponding one of at least three microphones of the portable device.

41 Claims, 23 Drawing Sheets

(51) Int. Cl.
*H04R 9/06* (2006.01)
*H04S 7/00* (2006.01)

(56) References Cited

U.S. PATENT DOCUMENTS

| | | | | |
|---|---|---|---|---|
| 6,507,659 | B1 | 1/2003 | Iredale et al. | |
| 7,327,852 | B2 | 2/2008 | Ruwisch | |
| 7,606,373 | B2 | 10/2009 | Moorer | |
| 8,855,341 | B2 | 10/2014 | Kim et al. | |
| 2002/0167862 | A1 | 11/2002 | Tomasi et al. | |
| 2003/0118197 | A1 | 6/2003 | Nagayasu et al. | |
| 2005/0069149 | A1* | 3/2005 | Takahashi et al. | 381/91 |
| 2005/0147257 | A1 | 7/2005 | Melchior et al. | |
| 2005/0226437 | A1 | 10/2005 | Pellegrini et al. | |
| 2006/0045294 | A1 | 3/2006 | Smyth | |
| 2006/0195324 | A1 | 8/2006 | Birk et al. | |
| 2008/0089531 | A1 | 4/2008 | Koga et al. | |
| 2008/0192968 | A1 | 8/2008 | Ho et al. | |
| 2008/0247562 | A1 | 10/2008 | Nagayasu et al. | |
| 2008/0247565 | A1 | 10/2008 | Elko et al. | |
| 2009/0012779 | A1 | 1/2009 | Ikeda et al. | |
| 2009/0129620 | A1 | 5/2009 | Tagawa et al. | |
| 2009/0164212 | A1 | 6/2009 | Chan et al. | |
| 2010/0046770 | A1 | 2/2010 | Chan et al. | |
| 2010/0098258 | A1* | 4/2010 | Thorn | 381/1 |
| 2011/0033063 | A1 | 2/2011 | McGrath et al. | |
| 2011/0038489 | A1 | 2/2011 | Visser et al. | |
| 2012/0128160 | A1 | 5/2012 | Kim et al. | |
| 2012/0128166 | A1 | 5/2012 | Kim et al. | |

FOREIGN PATENT DOCUMENTS

| | | | |
|---|---|---|---|
| JP | H07336250 | A | 12/1995 |
| JP | 2002135898 | A | 5/2002 |
| JP | 2005176063 | A | 6/2005 |
| JP | 2005176138 | A | 6/2005 |
| JP | 2006066988 | A | 3/2006 |
| JP | 2007266754 | A | 10/2007 |
| JP | 2007318373 | A | 12/2007 |
| JP | 2008507926 | A | 3/2008 |
| JP | 2008079255 | A | 4/2008 |
| JP | 2008512015 | A | 4/2008 |
| JP | 2008131616 | A | 6/2008 |
| JP | 2008193420 | A | 8/2008 |
| JP | 2008219458 | A | 9/2008 |
| JP | 2009044588 | A | 2/2009 |
| JP | 2009296232 | A | 12/2009 |
| JP | 2010506525 | A | 2/2010 |
| JP | 2010128952 | A | 6/2010 |
| JP | 2012523731 | A | 10/2012 |
| KR | 19990076219 | | 10/1999 |
| KR | 20090131237 | A | 12/2009 |
| WO | WO 2006028587 | A2 | 3/2006 |
| WO | WO-2007099908 | A1 | 9/2007 |
| WO | WO-2008043731 | A1 | 4/2008 |
| WO | WO-2009086017 | | 7/2009 |
| WO | WO-2009117471 | A1 | 9/2009 |
| WO | WO-2010048620 | A1 | 4/2010 |
| WO | WO-2010116153 | A1 | 10/2010 |

OTHER PUBLICATIONS

ISA/EPO—Mar. 5, 2012.

* cited by examiner

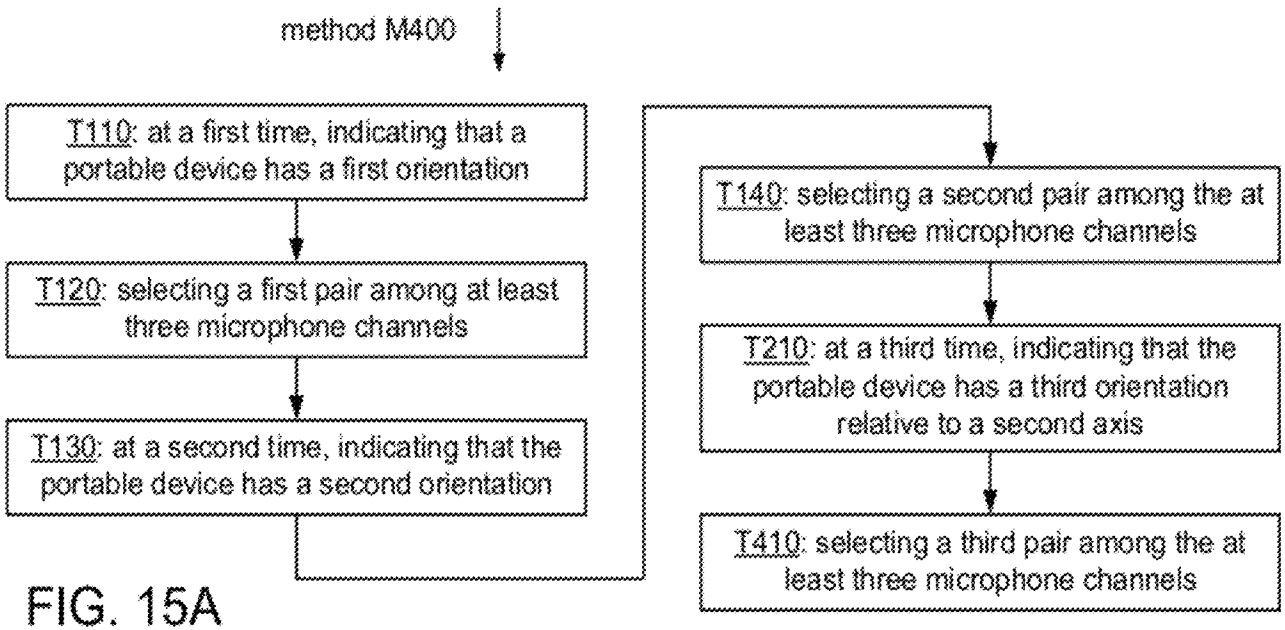
FIG. 15A
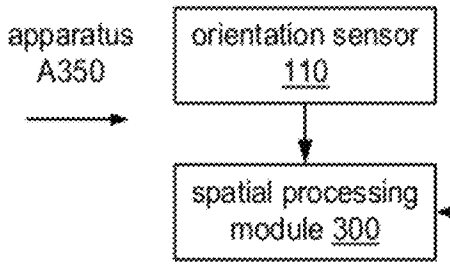
FIG. 15B
FIG. 15C

SYSTEMS, METHODS, APPARATUS, AND COMPUTER-READABLE MEDIA FOR ORIENTATION-SENSITIVE RECORDING CONTROL

CLAIM OF PRIORITY UNDER 35 U.S.C. §119

The present Application for Patent claims priority to Provisional Application No. 61/406,396, entitled "THREE-DIMENSIONAL SOUND CAPTURING AND REPRODUCING WITH MULTI-MICROPHONES," filed Oct. 25, 2010, and assigned to the assignee hereof.

CROSS REFERENCED APPLICATIONS

The present Application for Patent is related to the following co-pending U.S. Patent Applications:

Ser. No. 13/280,303 "THREE-DIMENSIONAL SOUND CAPTURING AND REPRODUCING WITH MULTI-MICROPHONES", filed concurrently herewith, assigned to the assignee hereof; and 13/280,203 "SYSTEMS, METHODS, APPARATUS, AND COMPUTER-READABLE MEDIA FOR HEAD TRACKING BASED ON RECORDED SOUND SIGNALS", filed concurrently herewith, assigned to the assignee hereof.

BACKGROUND

1. Field

This disclosure relates to audio signal processing.

2. Background

Many activities that were previously performed in quiet office or home environments are being performed today in acoustically variable situations like a car, a street, or a café. For example, a person may desire to communicate with another person using a voice communication channel. The channel may be provided, for example, by a mobile wireless handset or headset, a walkie-talkie, a two-way radio, a car-kit, or another communications device. Consequently, a substantial amount of voice communication is taking place using portable audio sensing devices (e.g., smartphones, handsets, and/or headsets) in highly variable environments. Incorporation of video recording capability into communications devices also presents new opportunities and challenges.

SUMMARY

A method of orientation-sensitive recording control according to a general configuration includes indicating, within a portable device and at a first time, that the portable device has a first orientation relative to a gravitational axis and, based on the indication, selecting a first pair among at least three microphone channels of the portable device. This method also includes indicating, within the portable device and at a second time that is different than the first time, that the portable device has a second orientation relative to the gravitational axis that is different than the first orientation and, based on the indication, selecting a second pair among the at least three microphone channels that is different than the first pair. In this method, each of the at least three microphone channels is based on a signal produced by a corresponding one of at least three microphones of the portable device. Computer-readable storage media (e.g., non-transitory media) having tangible features that cause a machine reading the features to perform such a method are also disclosed.

An apparatus for orientation-sensitive recording control according to a general configuration includes means for indicating, at a first time, that a portable device has a first orientation relative to a gravitational axis, and means for selecting a first pair among at least three microphone channels of the portable device, based on said indication that the portable device has the first orientation. This apparatus also includes means for indicating, at a second time that is different than the first time, that the portable device has a second orientation relative to the gravitational axis that is different than the first orientation, and means for selecting a second pair among the at least three microphone channels that is different than the first pair, based on said indication that the portable device has the second orientation. In this apparatus, each of the at least three microphone channels is based on a signal produced by a corresponding one of at least three microphones of the portable device.

An apparatus for orientation-sensitive recording control according to another general configuration includes an orientation sensor configured to indicate, at a first time, that a portable device has a first orientation relative to a gravitational axis, and a microphone channel selector configured to select a first pair among at least three microphone channels of the portable device, based on said indication that the portable device has the first orientation. The orientation sensor is configured to indicate, at a second time that is different than the first time, that the portable device has a second orientation relative to the gravitational axis that is different than the first orientation. The microphone channel selector is configured to select a second pair among the at least three microphone channels that is different than the first pair, based on said indication that the portable device has the second orientation. In this apparatus, each of the at least three microphone channels is based on a signal produced by a corresponding one of at least three microphones of the portable device.

BRIEF DESCRIPTION OF THE DRAWINGS

FIG. 15A shows a flowchart of an implementation M400 of method M100.

FIG. 15B shows a block diagram of an apparatus A300.

FIG. 15C shows a block diagram of an implementation A350 of apparatus A300.

DETAILED DESCRIPTION

Figure 1:
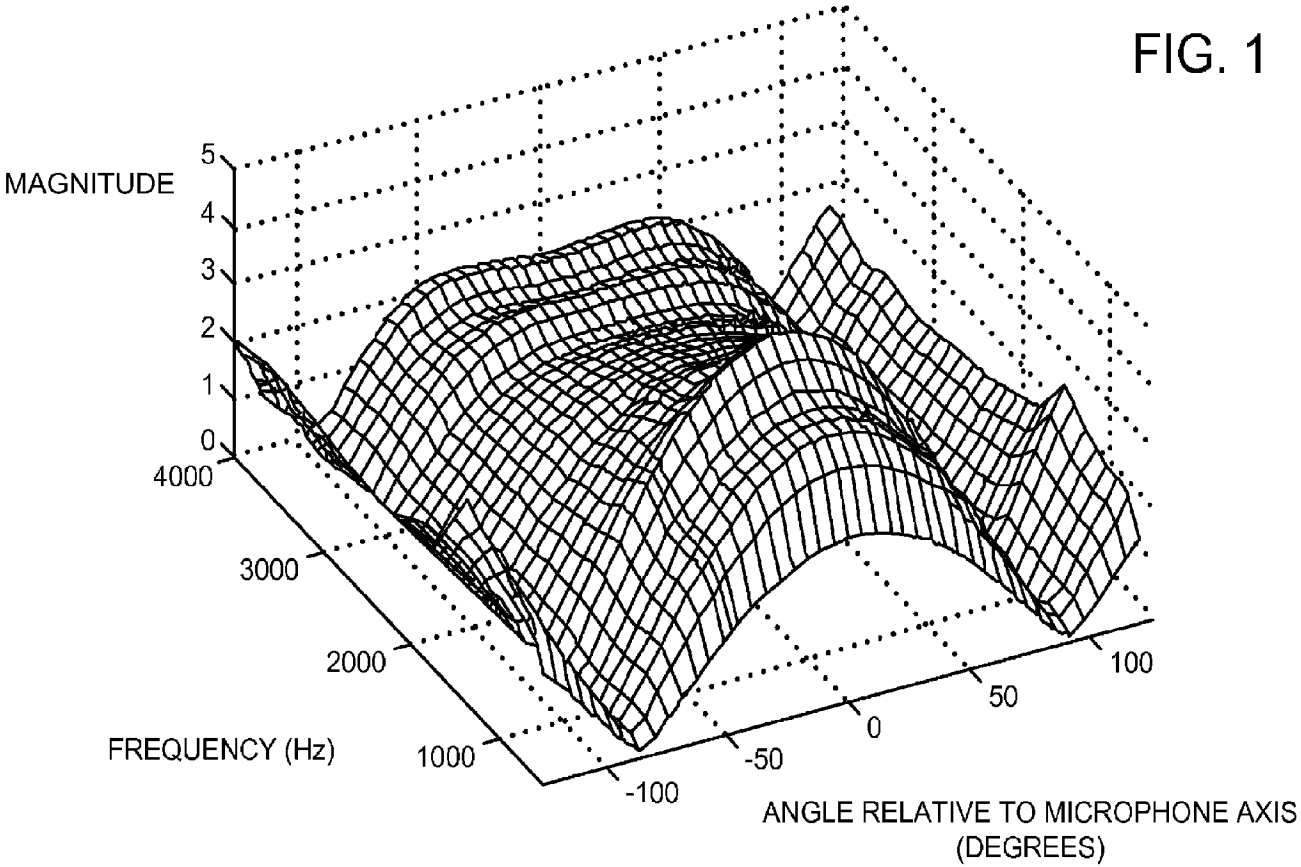
FIG. 1 shows a plot of the magnitude response for one example of a spatially selective filter.

Nowadays we are experiencing prompt exchange of individual information through rapidly growing social network services such as Facebook, Twitter, etc. At the same time, we also see the distinguishable growth of network speed and storage, which already supports not only text, but also multimedia data. In this environment, we see an important need for capturing and reproducing three-dimensional (3D) audio for more realistic and immersive exchange of individual aural experiences.

Multi-microphone-based audio processing algorithms have recently been developed in the context of enhancing speech communication. This disclosure describes several unique features for 3D audio based on a multi-microphone topology.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

A method as described herein may be configured to process the captured signal as a series of segments. Typical segment lengths range from about five or ten milliseconds to about forty or fifty milliseconds, and the segments may be overlapping (e.g., with adjacent segments overlapping by 25% or 50%) or nonoverlapping. In one particular example, the signal is divided into a series of nonoverlapping segments or "frames", each having a length of ten milliseconds. A segment as processed by such a method may also be a segment (i.e., a "subframe") of a larger segment as processed by a different operation, or vice versa.

A portable audio sensing device may be implemented to have a configurable multi-microphone array geometry. Depending on the use case, different combinations (e.g., pairs) of the microphones of the device may be selected to support spatially selective audio recording in different source directions.

During the operation of a multi-microphone audio sensing device, a microphone array produces a set of microphone channels in which each channel is based on the response of a corresponding one of the microphones to the acoustic environment. One microphone of the array may receive a particular sound more directly than another microphone, such that the corresponding channels differ from one another to provide collectively a more complete representation of the acoustic environment than can be captured using a single microphone.

A spatially selective recording operation may include filtering a multichannel signal, where the gain response of the filter differs according to direction of arrival. FIG. 1 shows a plot of the magnitude response, in terms of frequency bin vs. direction of arrival, for one example of such a spatially selective filter. Such a response is also called a "beam pattern," and the term "beam pattern" is also used herein (and in the appended claims) to denote the spatially selective filter itself. The "direction" of a beam pattern is the direction, relative to the array axis, in which the main beam of the beam pattern is oriented (zero degrees, in the example of FIG. 1). A beam pattern is typically symmetrical around the axis of the array.

One class of spatially selective filters is beamformers, which include phased arrays, minimum variance distortionless response (MVDR) beamformers, and linearly constrained minimum variance (LCMV) beamformers. Such a filter is typically calculated offline according to a desired direction of the beam pattern but may be calculated and/or adapted online (e.g., based on characteristics of a noise component of the multichannel signal). Another class of spatially selective filters is blind source separation (BSS) filters, which include filters whose coefficients are calculated using independent component analysis (ICA) or independent vector analysis (IVA). A BSS filter is typically trained offline to an initial state and may be further adapted online.

It may be desirable to configure a recording operation to select among several spatially selective filtering operations according to a desired recording direction. For example, a recording operation may be configured to apply a selected one of two or more beam patterns according to the desired recording direction. In such a case, the recording operation may be configured to select the beam pattern whose direction is closest to the desired recording direction.

Figure 2A:
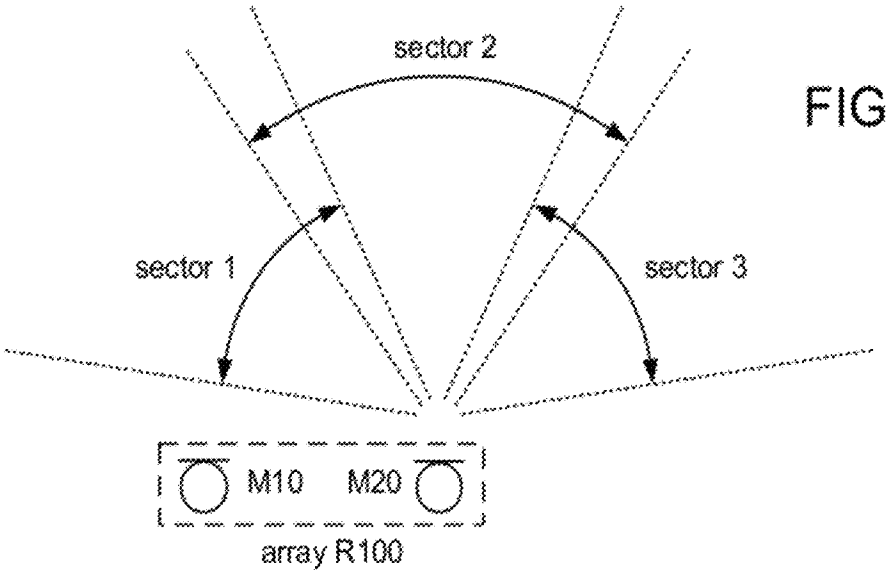
FIG. 2A shows a typical use case of a two-microphone implementation of a microphone array R100.

FIG. 2A shows a typical use case of a two-microphone implementation of a microphone array R100 that includes microphones M10 and M20. Array R100 is configured to produce a set of microphone channels in which each channel is based on a signal produced by a corresponding one of the microphones. In this example, a spatially selective recording operation that is configured to select among three overlapping spatial sectors is applied to the microphone channels. Such an operation may include selecting and applying a beam pattern whose direction corresponds to the desired sector.

Figure 2B:
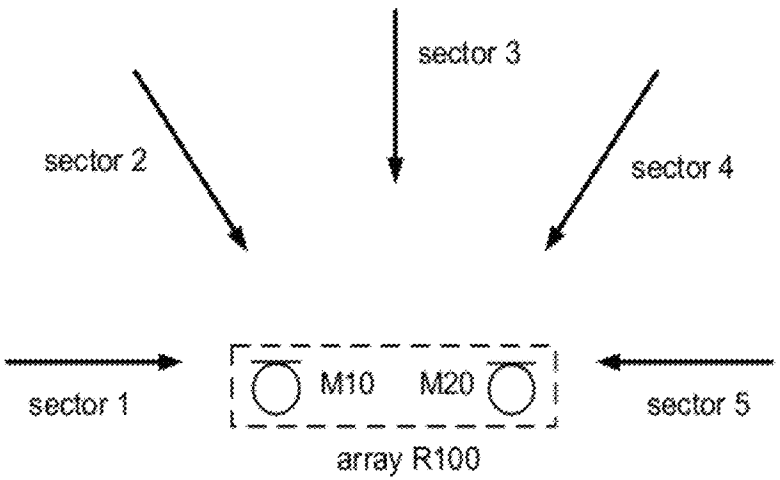
FIG. 2B shows another use case of array R100.

FIG. 2B shows another use case of array R100 in which the recording operation is configured to select among five sectors, where each arrow indicates the central direction of arrival of the corresponding sector (e.g., to select among five beam patterns, where each arrow indicates the direction of the corresponding beam pattern). Although FIGS. 2A and 2B show arrays that are microphone pairs, the principles of spatially selective recording described herein are generalizable to more than two microphones in a linear array, with uniform or nonuniform spacing between adjacent pairs, and also to more than two microphones in a nonlinear array, and such generalization is expressly contemplated and hereby disclosed. For example, disclosure of application of a spatially selective filter to a pair of microphone channels also discloses application of a similarly spatially selective filter to more than two (e.g., three, four, or five) microphone channels. The number and widths of the sectors may be selected according to, for example, a desired tradeoff between main beam width and sidelobe generation, and a linear array having a greater number of microphones may be expected to support a more narrow main beam without generating unacceptably high sidelobes.

Additionally or alternatively, a spatially selective recording operation may be configured to select a beam pattern that has a null beam in a desired direction. Such selection may be desirable for blocking sound components from an interfering source. For example, it may be desired to select a beam pattern according to both its direction (i.e., of the main beam) and the direction of its null beam. In the example of FIG. 1, the direction of the null beam with respect to the array axis is ninety degrees.

Figure 3:
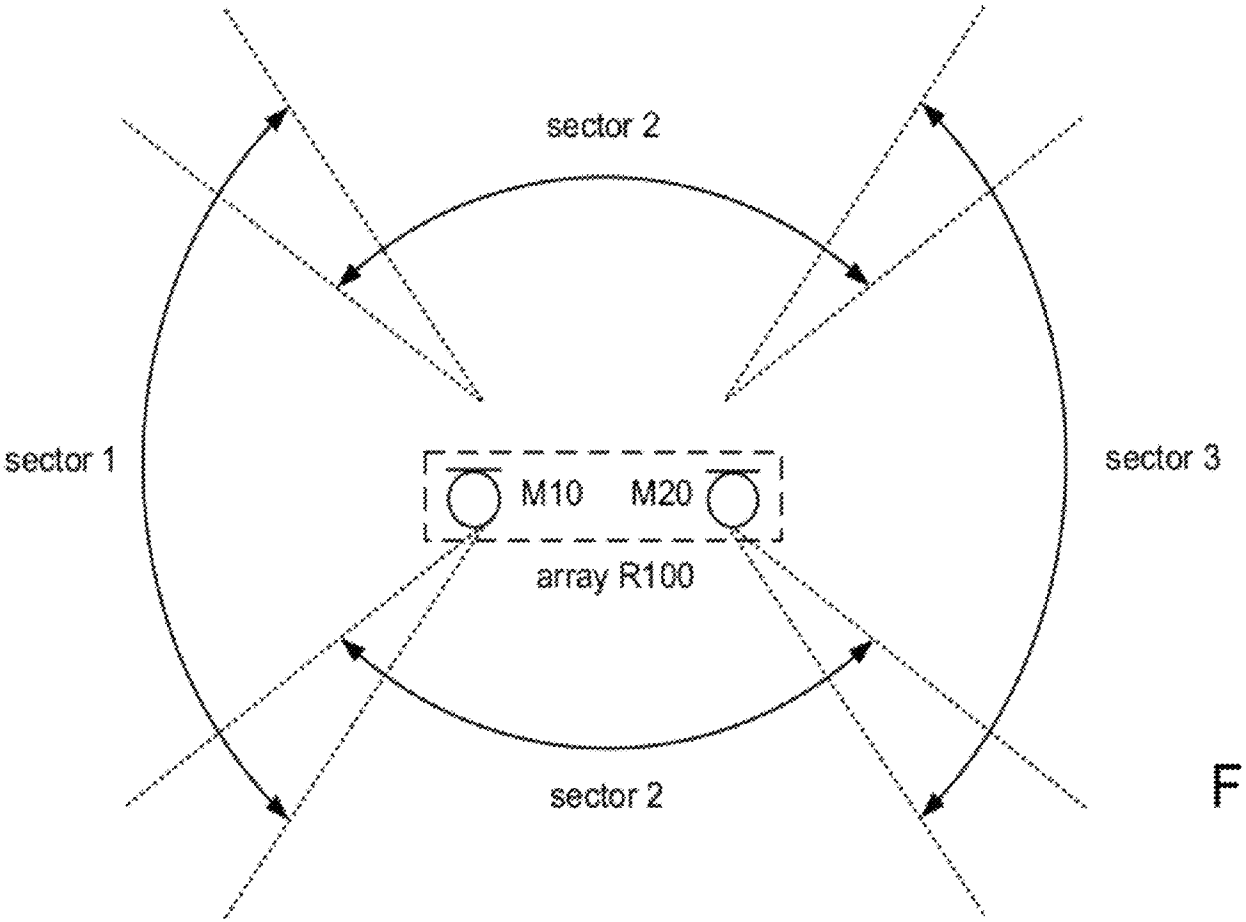
FIG. 3 shows an example of a typical use case of array R100.
Figure 6A:
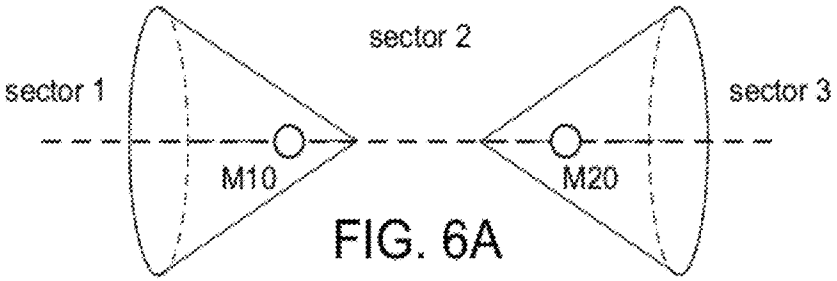
FIG. 6A shows an example in which microphones M10 and M20 are omnidirectional.

As noted above, a beam pattern is typically symmetrical around the axis of the array. For a case in which the microphones are omnidirectional, therefore, the pickup cones that correspond to the specified ranges of direction may be ambiguous with respect to the front and back of the microphone pair (e.g., as shown in FIG. 6A). FIG. 3 shows an example of a typical use case of array R100 in which the cones of endfire sectors 1 and 3 are symmetrical around the array axis, and in which sector 2 occupies the space between those cones.

It may be desirable to calculate a set of beam patterns offline, to support online selection among the beam patterns. For an example in which the device includes multiple possible array configurations (e.g., multiple possible microphone pairs), it may be desirable to calculate a different set of beam patterns offline for each of two or more of the possible array configurations. However, it is also possible to apply the same beam pattern to different array configurations, as a similar response may be expected if the dimensions of the configurations are the same and the individual responses of the microphones of each array are matched.

A spatially selective filter may be implemented to filter a multichannel signal to produce a desired signal in an output channel. Such a filter may also be implemented to produce a noise estimate in another output channel. A potential advantage of such a noise estimate is that it may include nonstationary noise events from other directions. Single-channel audio processing systems are typically unable to distinguish nonstationary noise that occurs in the same frequencies as the desired signal.

Figure 4:
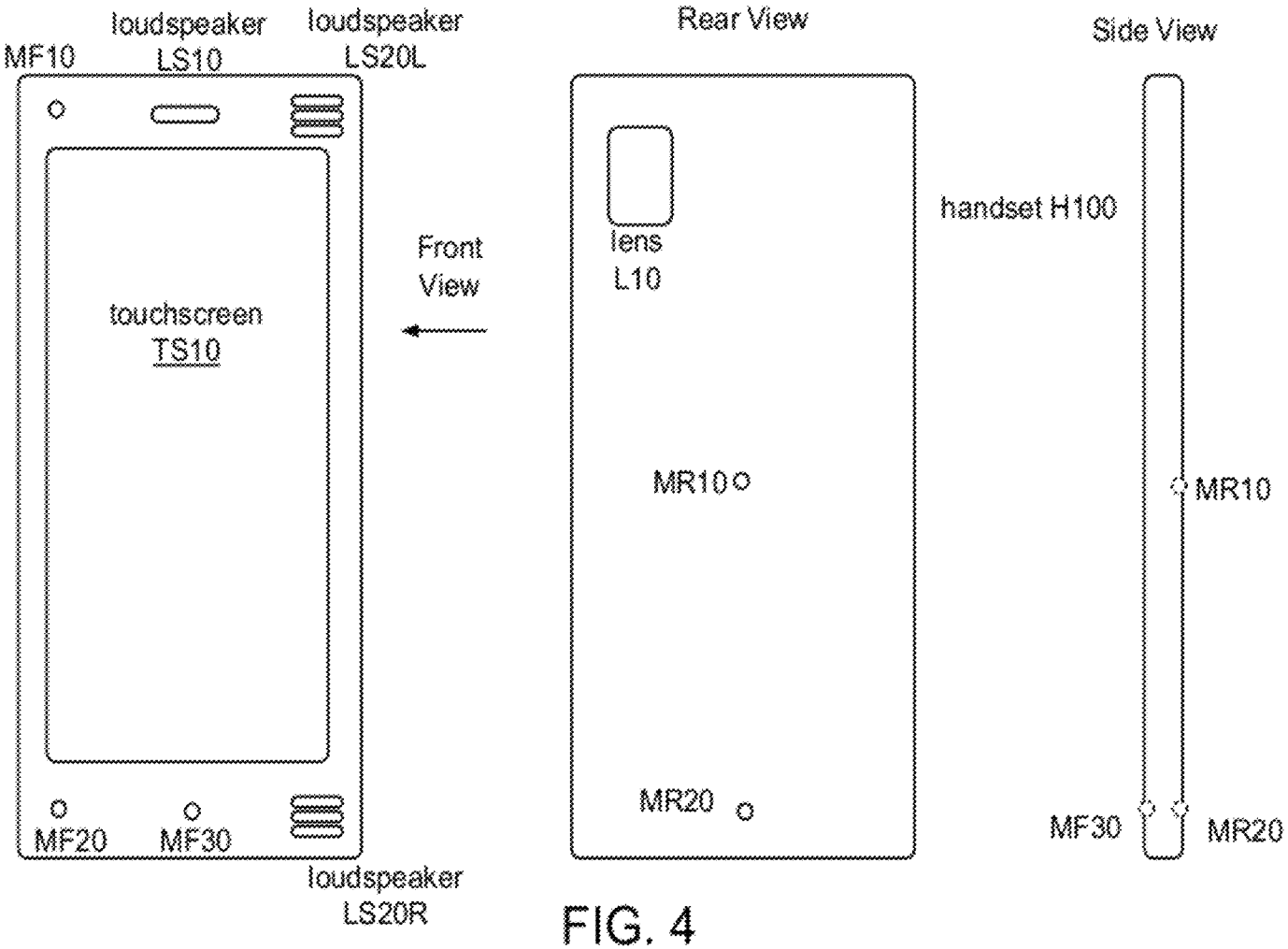
FIG. 4 shows front, rear, and side views of a handset H100.

FIG. 4 shows front, rear, and side views of an implementation H100 of a multi-microphone audio sensing device as a cellular telephone handset (e.g., a smartphone). Handset H100 includes three microphones MF10, MF20, and MF30 arranged on the front face of the device; and two microphones MR10 and MR20 arranged on the rear face. A maximum distance between the microphones of such a handset is typically about ten or twelve centimeters.

Figure 5:
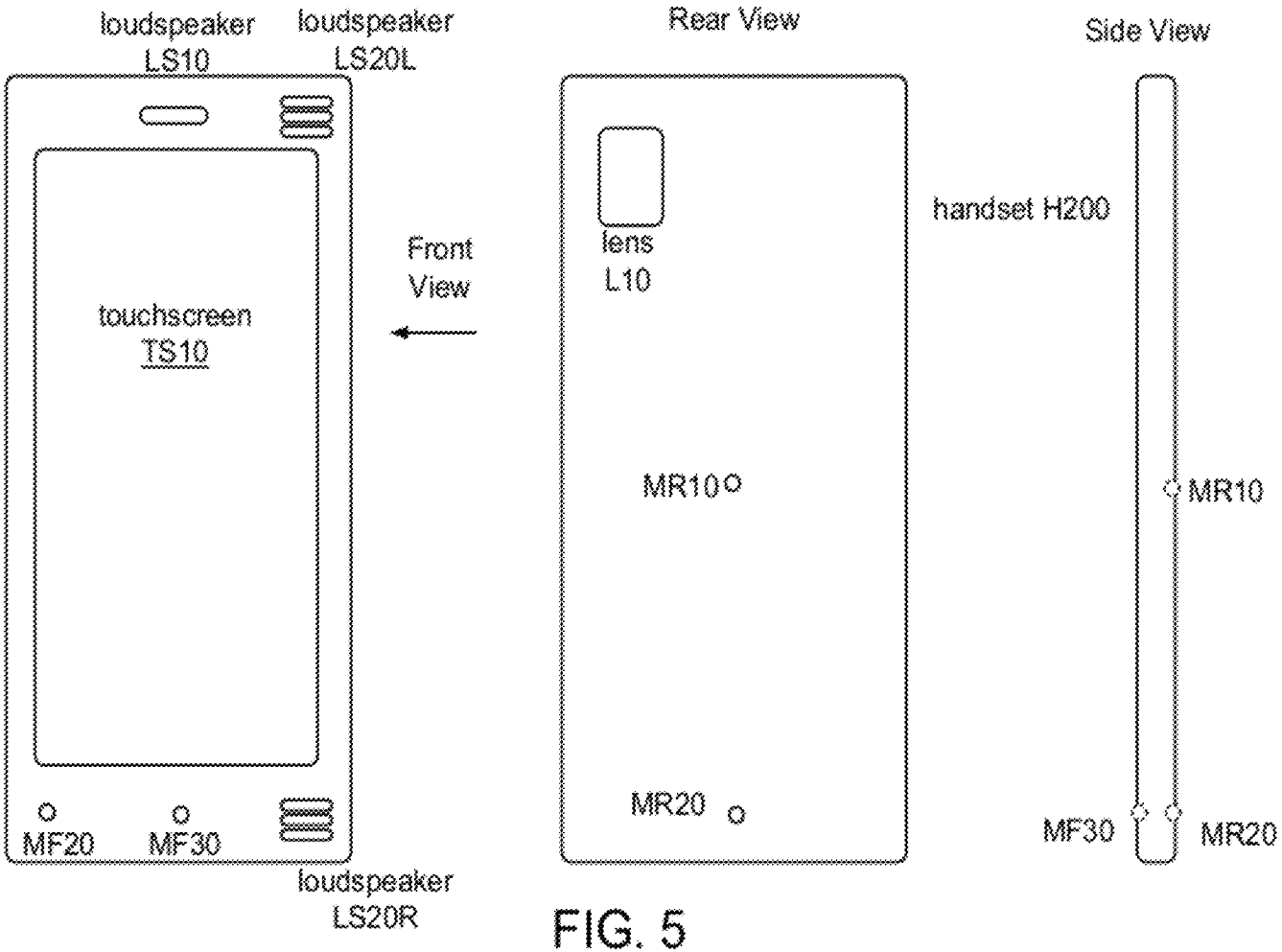
FIG. 5 shows similar views of a similar handset H200.

Lens L10 of a camera of handset H100 is also arranged on the rear face, and it is assumed in this case that the effective imaging axis of the device is orthogonal to the plane of touchscreen TS10. Alternative placements of lens L10 and corresponding imaging path arrangements are also possible, such as an effective imaging axis that is parallel to either axis of symmetry of touchscreen TS10. A loudspeaker LS10 is arranged in the top center of the front face near microphone MF10, and two other loudspeakers LS20L, LS20R are also provided (e.g., for speakerphone applications). FIG. 5 shows similar views of a similar handset H200 having four microphones.

Handset H100 may be used for video recording via lens L10, using an internal imaging sensor that captures a sequence of images received via the lens and a video recording module that encodes the image sequence for storage and/or transmission. In this case, a front-back microphone pair can be used to record front and back directions (i.e., to steer beams into and away from the camera point direction). Examples of microphone pairs that may be used as an implementation of array R100 to provide directional recording with respect to a front-back axis include microphones MF30 and MR10, microphones MF30 and MR20, and microphones MF10 and MR10, with left and right direction preferences that may be manually or automatically configured. For directional sound recording with respect to one axis that is orthogonal to the front-back axis, an implementation of array R100 that includes microphone pair MR10 and MR20 is one option. For directional sound recording with respect to another axis that is orthogonal to the front-back axis, an implementation of array R100 that includes microphone pair MF20 and MF30 is another option.

It may be desirable to record audio from a particular direction and/or to suppress audio from a particular direction. For example, it may be desirable to record a desired signal that arrives from the direction of the user of the device (e.g., to support narration of the recorded video sequence by the user), or from the direction of a companion of the user, or from the direction of a performance stage or other desired sound source, while suppressing sound arriving from other directions. Alternatively or additionally, it may be desirable to record audio while suppressing interfering sound arriving from a particular direction, such as a loudspeaker of a public address (PA) system, a television or radio, or a loud spectator at a sporting event.

It may also be desirable to provide robust sound direction tracking and maintaining. In such case, it may be desirable to implement the device to maintain a selected recording direction, regardless of the current orientation of the device. Once a preferred recording direction has been specified for a given holding angle of the device, for example, it may be desirable to maintain this direction even if the holding angle of the device subsequently changes.

The response of a spatially selective filter as applied to a pair of microphone channels may be described in terms of an angle relative to the array axis. FIG. 6A shows an example in which microphones M10 and M20 are omnidirectional. In such case, the selectivity of the filter may be described in space by cones along the array axis. For example, the filter may be implemented to have a gain response for signal components that arrive from endfire sector 1 that is different from its gain response for signal components that arrive from broadside sector 2 or endfire sector 3.

Figure 6B:
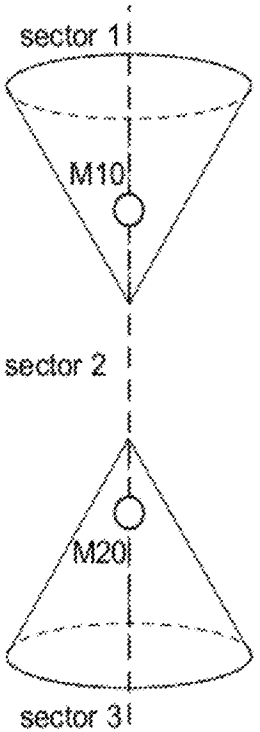
FIG. 6B shows another example in which microphones M10 and M20 are omnidirectional.
Figure 7:
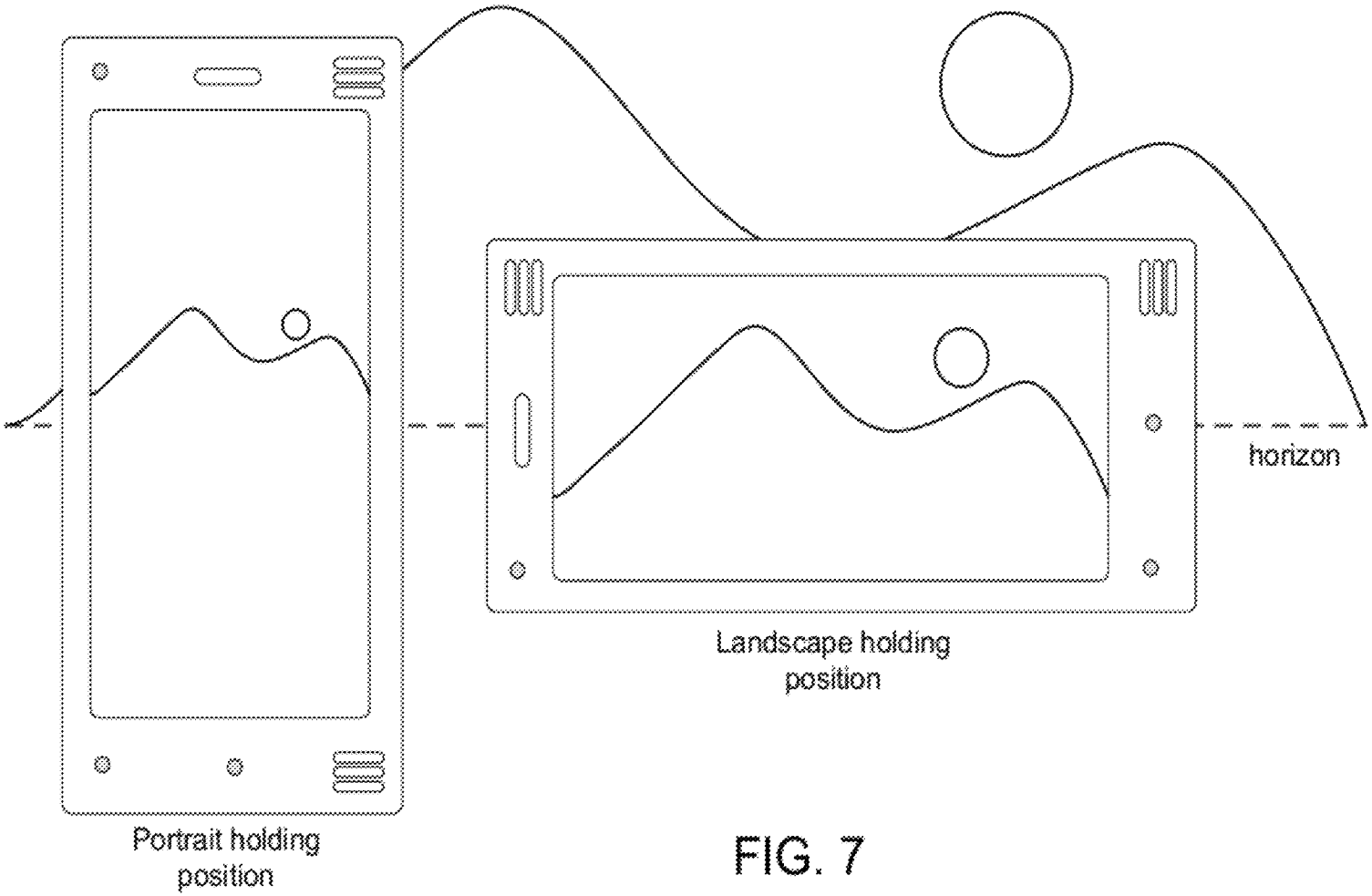
FIG. 7 shows handset H100 in a landscape holding position and in a portrait holding position.

When the array axis is horizontal, such selectivity may be used to separate signal components that arrive from different directions in a horizontal plane (i.e., a plane that is orthogonal to the gravitational axis). When the array axis is vertical, however, as shown in FIG. 6B, it may be difficult or impossible to distinguish among these signal components based on direction alone. Such a change in the array axis may occur when the device is rotated between a landscape holding position and a portrait holding position as shown in FIG. 7. In a landscape holding position, the longer aspect of the display screen is closer to parallel to the horizon than the shorter aspect of the display screen. In a portrait holding position, the shorter aspect of the display screen is closer to parallel to the horizon than the longer aspect of the display screen.

It may be desirable to avoid a loss of spatial directivity in a horizontal plane when the device is rotated between a landscape holding position and a portrait holding position. For example, it may be desirable to use a different microphone pair for recording in the new device orientation such that the desired spatial selectivity in the horizontal plane is maintained. The device may include one or more orientation sensors to detect an orientation of the device. When the device is rotated between landscape and portrait holding positions, for example, it may be desirable to detect such rotation and, in response to the detection, to select the microphone pair whose axis is closest to horizontal, given the current device orientation. Typically the location of each of the orientation sensors within the portable device is fixed.

Such preservation of a desired spatial selectivity may be obtained by using one or more orientation sensors (e.g., one or more accelerometers, gyroscopic sensors, and/or magnetic sensors) to track the orientation of the handset in space. Such tracking may be performed according to any such technique known in the art. For example, such tracking may be performed according to a technique that supports rotation of the display image on a typical smartphone when changing between a landscape holding position to a portrait holding position. Descriptions of such techniques may be found, for example, in U.S. Publ. Pat. Appls. Nos. 2007/0032886 A1 (Tsai), entitled "ELECTRONIC APPARATUS CAPABLE OF ADJUSTING DISPLAY DIRECTION AND DISPLAY_DIRECTION ADJUSTING METHOD THEREOF"; 2009/0002218 A1 (Rigazio et al.), entitled "DIRECTION AND HOLDING-STYLE INVARIANT, SYMMETRIC DESIGN, TOUCH AND BUTTON BASED REMOTE USER INTERACTION DEVICE"; 2009/0207184 A1(Laine et al.), entitled "INFORMATION PRESENTATION BASED ON DISPLAY SCREEN ORIENTATION"; and 2010/0129068 A1 (Binda et al.), entitled "DEVICE AND METHOD FOR DETECTING THE ORIENTATION OF AN ELECTRONIC APPARATUS". Such adjustment of spatial recording directions based on relative phone orientations may help to maintain a consistent spatial image in the audio recording (e.g., with respect to a contemporaneous video recording).

Figure 6C:
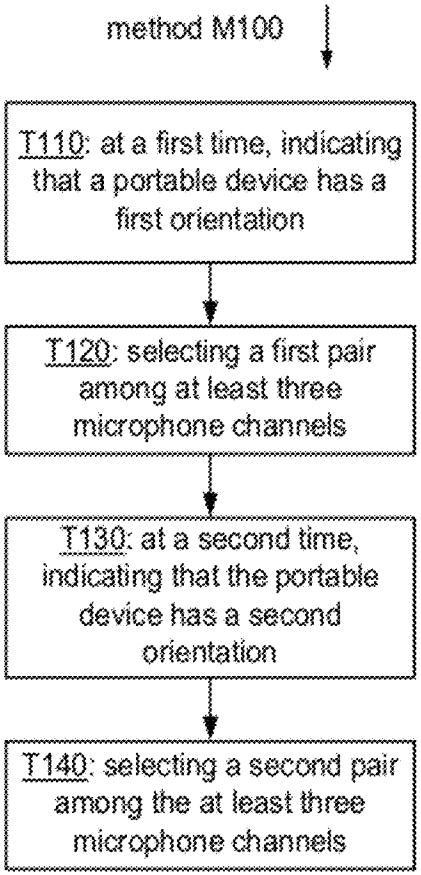
FIG. 6C shows a flowchart of a method M100 according to a general configuration.

FIG. 6C shows a flowchart of a method M100 according to a general configuration that includes tasks T110, T120, T130, and T140. At a first time, task T110 indicates that a portable device has a first orientation relative to a gravitational axis. For example, task T110 may indicate that the device is in one among a landscape holding position and a portrait holding position. Task T120 selects a first pair among at least three microphone channels of the portable device, based on the indication that the portable device has the first orientation. At a second time that is different than (e.g., subsequent to) the first time, task T130 indicates that the portable device has a second orientation relative to the gravitational axis that is different than the first orientation. For example, task T130 may indicate that the device is in the other among a landscape holding position and a portrait holding position. Task T140 selects a second pair among the at least three microphone channels that is different than the first pair, based on the indication that the portable device has the second orientation. In this method, each of the at least three microphone channels is based on a signal produced by a corresponding one of at least three microphones of the portable device.

The indications produced by tasks T110 and T130 may have the form of a measure of an angle relative to the gravitational axis (e.g., in degrees or radians). Such a measure may also be indicated as one within a range of values (e.g., an 8-bit value from 0 to 255). In such cases, tasks T120 and T140 may be configured to compare the corresponding indications to a threshold value (e.g., forty-five degrees or a corresponding value in the range) and to select the channel pair according to a result of the comparison. In another example, the indications produced by tasks T110 and T130 are binary values that have one state when the device is in a portrait holding pattern and the other state when the device is in a landscape holding pattern (e.g., "0", "low", or "off" and "1", "high", or "on", respectively, or vice versa).

Figure 8C:
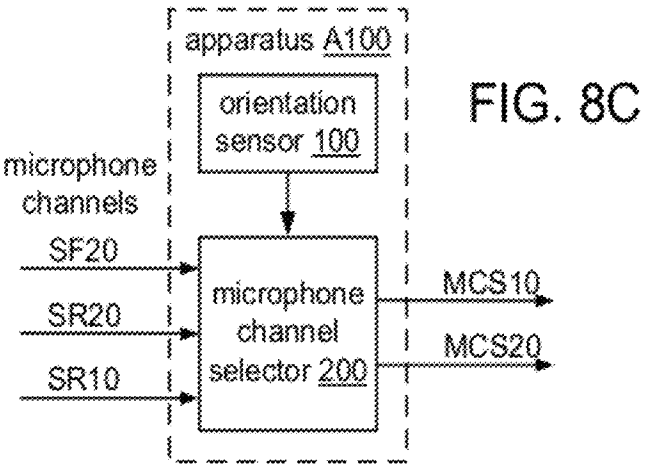
FIG. 8C shows a block diagram of an application of apparatus A100.
Figure 8D:
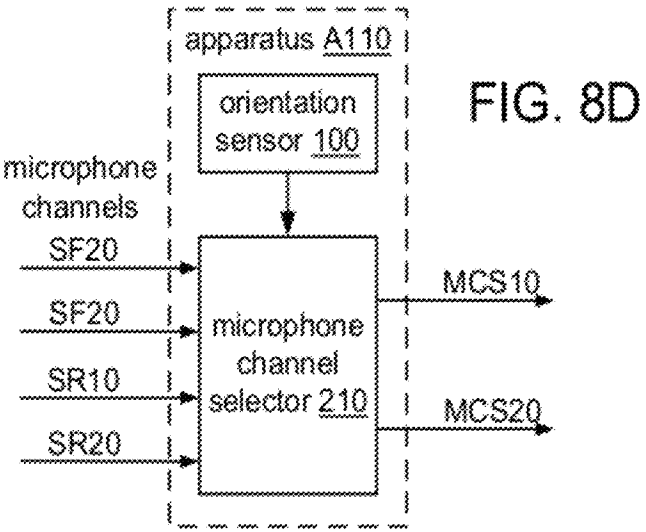
FIG. 8D shows a block diagram of such an implementation A110 of apparatus A100.
Figure 8B:
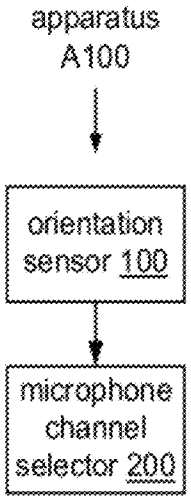
FIG. 8B shows a block diagram of an apparatus A100 according to a general configuration.
Figure 8A:
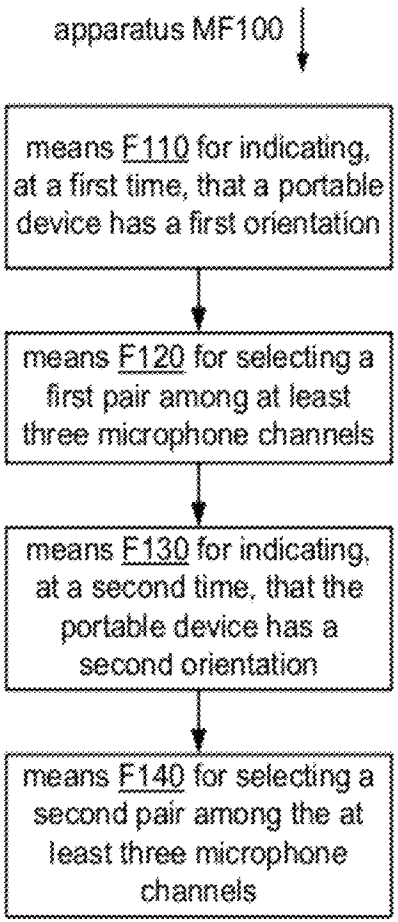
FIG. 8A shows a block diagram of an apparatus MF100 according to a general configuration.

FIG. 8A shows a block diagram of an apparatus MF100 according to a general configuration. Apparatus MF100 includes means F110 for indicating, at a first time, that a portable device has a first orientation relative to a gravitational axis (e.g., as described herein with reference to task T110). Apparatus MF100 also includes means F120 for selecting a first pair among at least three microphone channels of the portable device, based on the indication that the portable device has the first orientation (e.g., as described herein with reference to task T120). Apparatus MF100 also includes means F130 for indicating, at a second time that is different than the first time, that the portable device has a second orientation relative to the gravitational axis that is different than the first orientation (e.g., as described herein with reference to task T130). Apparatus MF100 also includes means F140 for selecting a second pair among the at least three microphone channels that is different than the first pair, based on the indication that the portable device has the second orientation (e.g., as described herein with reference to task T140). In this apparatus, each of the at least three microphone channels is based on a signal produced by a corresponding one of at least three microphones of the portable device.

FIG. 8B shows a block diagram of an apparatus A100 according to a general configuration that includes an orientation sensor 100 and a microphone channel selector 200. At a first time, orientation sensor 100 indicates that a portable device has a first orientation relative to a gravitational axis (e.g., as described herein with reference to task T110). Based on this indication, microphone channel selector 200 selects a first pair among at least three microphone channels of the portable device (e.g., as described herein with reference to task T120). At a second time that is different than the first time, orientation sensor 100 indicates that the portable device has a second orientation relative to the gravitational axis that is different than the first orientation (e.g., as described herein with reference to task T130). Based on this indication, microphone channel selector 200 selects a second pair among the at least three microphone channels that is different than the first pair (e.g., as described herein with reference to task T140). In this apparatus, each of the at least three microphone channels is based on a signal produced by a corresponding one of at least three microphones of the portable device.

Orientation sensor 100 may include one or more inertial sensors, such as gyroscopes and/or accelerometers. A gyroscope uses principles of angular momentum to detect changes in orientation about an axis or about each of two or three (typically orthogonal) axes (e.g., changes in pitch, roll and/or twist). Examples of gyroscopes, which may be fabricated as micro-electromechanical systems (MEMS) devices, include vibratory gyroscopes. An accelerometer detects acceleration along an axis or along each of two or three (typically orthogonal) axes. An accelerometer may also be fabricated as a MEMS device. It is also possible to combine a gyroscope and an accelerometer into a single sensor. Additionally or alternatively, orientation sensor 100 may include one or more magnetic field sensors (e.g., magnetometers), which measure magnetic field strength along an axis or along each of two or three (typically orthogonal) axes. In one example, a magnetic field sensor is used to indicate an orientation of the device in a plane orthogonal to the gravitational axis.

FIG. 8C shows a block diagram of an application of apparatus A100. In this application, apparatus A100 receives microphone channels SF20, SR20, and SR10, which are based on signals produced by microphones MF20, MR20, and MR10, respectively. In this example, microphone channel selector 200 may be configured to select the channel pair SF20-SR20 in response to an indication by orientation sensor 100 of an orientation relative to the gravitational axis that corresponds to a portrait holding pattern, and to select the channel pair SR10-SR20 in response to an indication by orientation sensor 100 of an orientation relative to the gravitational axis that corresponds to a landscape holding pattern. In this example, channel SR20 is common to both selections, and microphone channel selector 200 is configured to produce the selected pair as respective channels MCS10 and MCS20 of a multichannel signal.

Apparatus A100 may also be implemented such that no microphone channel is common to both selected pairs. FIG. 8D shows a block diagram of such an implementation A110 of apparatus A100. In this application, apparatus A110 receives microphone channels SF10, SF20, SR10, and SR20, which are based on signals produced by microphones MF10, MF20, MR10, and MR20, respectively. Apparatus A110 includes an implementation 210 of microphone channel selector 200. Selector 210 is configured to select the channel pair SF10-SF20 in response to an indication by orientation sensor 100 that corresponds to a portrait holding pattern, and to select the channel pair SR10-SR20 in response to an indication by orientation sensor 100 that corresponds to a landscape holding pattern.

Figure 9B:
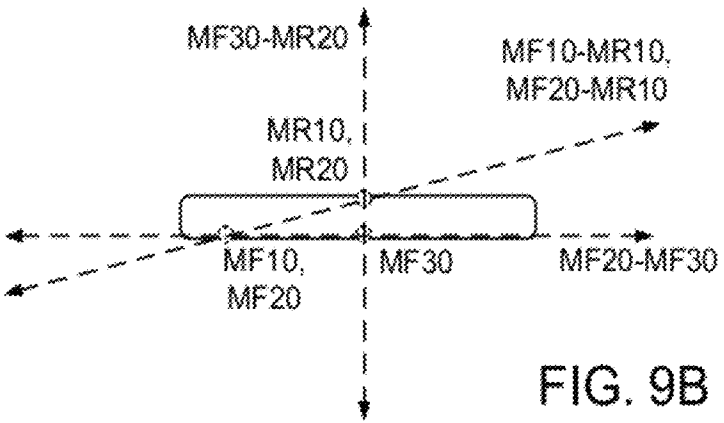
FIG. 9B shows examples of four different microphone pairs of handset H100 that may be used in a portrait holding position.
Figure 9A:
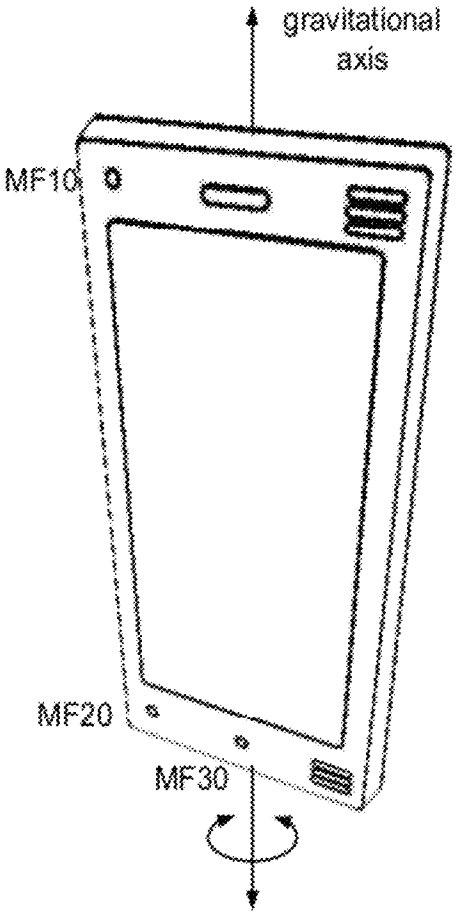
FIG. 9A illustrates a rotation of handset H100 while in a portrait holding position.
Figure 10A:
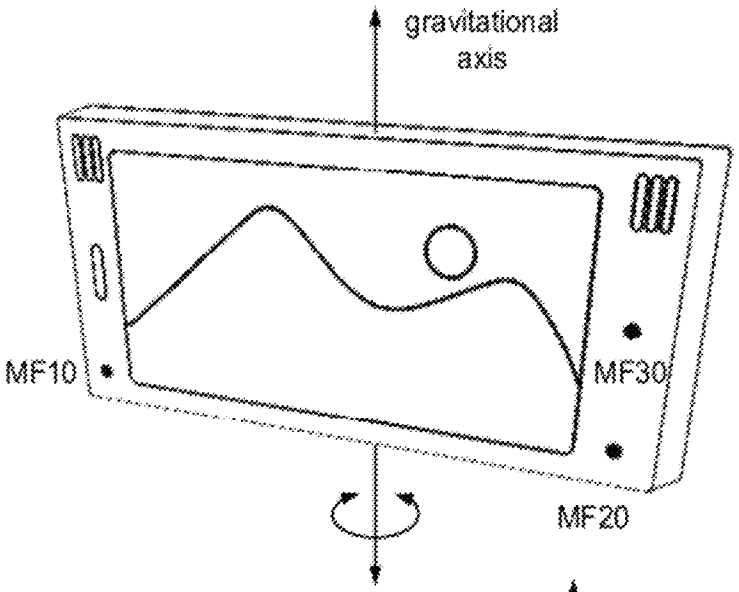
FIG. 10A illustrates a rotation of handset H100 while in a landscape holding position.

As described above, sensing a rotation about a line that is orthogonal to the gravitational axis may be used to select a microphone pair that is expected to support a desired spatial selectivity in a horizontal plane. Additionally or alternatively to such selection, it may be desirable to maintain recording selectivity in a desired direction in the horizontal plane as the device is rotated about the gravitational axis. FIG. 9A illustrates such a rotation of handset H100 while in a portrait holding position, and FIG. 10A illustrates such a rotation of handset H100 while in a landscape holding position. Such rotation may occur intentionally (e.g., for video recording of a moving object, or to capture a video panorama) or unintentionally (e.g., due to hand shaking).

Figure 11A:
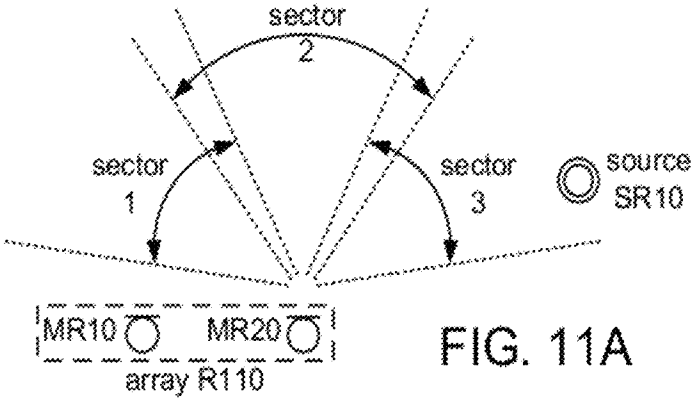
FIG. 11A shows a top view of handset H100 in a landscape holding position.

FIG. 11A shows a top view (e.g., along the gravitational axis) of handset H100 in a landscape holding position. In this example, an implementation R110 of array R100 that includes microphones MR10 and MR20 produces a pair of microphone channels. A spatial processing module processes this signal to select among three sectors as shown in the figure.

FIG. 11A also shows a location of a desired static sound source SR10. At the time shown in FIG. 11A, the direction of source SR10 with respect to the axis of array R110 is in spatial sector 3. In this case, a beam pattern which is directed to select signal components arriving from sector 3 may provide good separation with respect to source SR10.

Figure 11B:
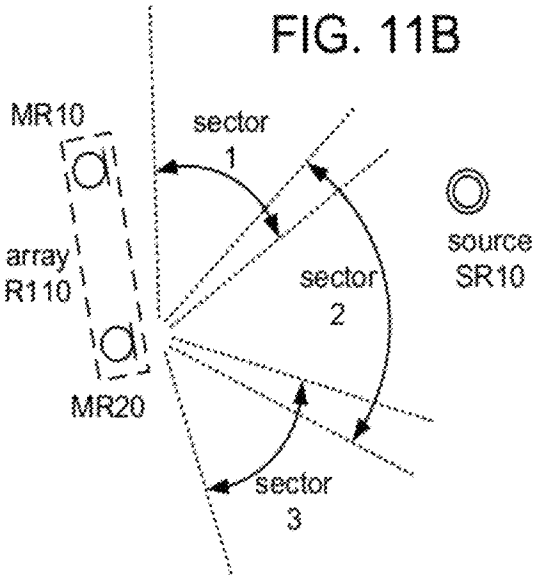
FIG. 11B shows an example of the arrangement in FIG. 11A at a different time.
Figure 11C:
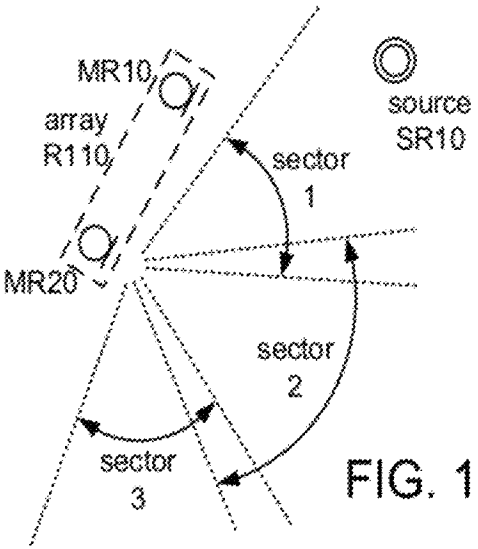
FIG. 11C shows an example of the arrangement in FIG. 11A at another different time.

FIG. 11B shows an example of the arrangement in FIG. 11A at a different time. At this time, handset H100 has been rotated about the gravitational axis such that the direction of source SR10 is now in spatial sector 2. FIG. 11C shows an example of the arrangement in FIG. 11A at another different time. At this time, handset H100 has been rotated about the gravitational axis such that the direction of source SR10 is now in spatial sector 1. In these two cases, a beam pattern which is directed to select signal components arriving from sector 3 may fail to provide a desired selectivity with respect to source SR10.

It may be desirable to configure a spatial processing module to maintain a desired directional selectivity regardless of the current orientation of the device. For example, it may be desirable to configure the spatial processing module to select a beam pattern based on a desired direction and on a current orientation of the device about the gravitational axis.

Figure 12:
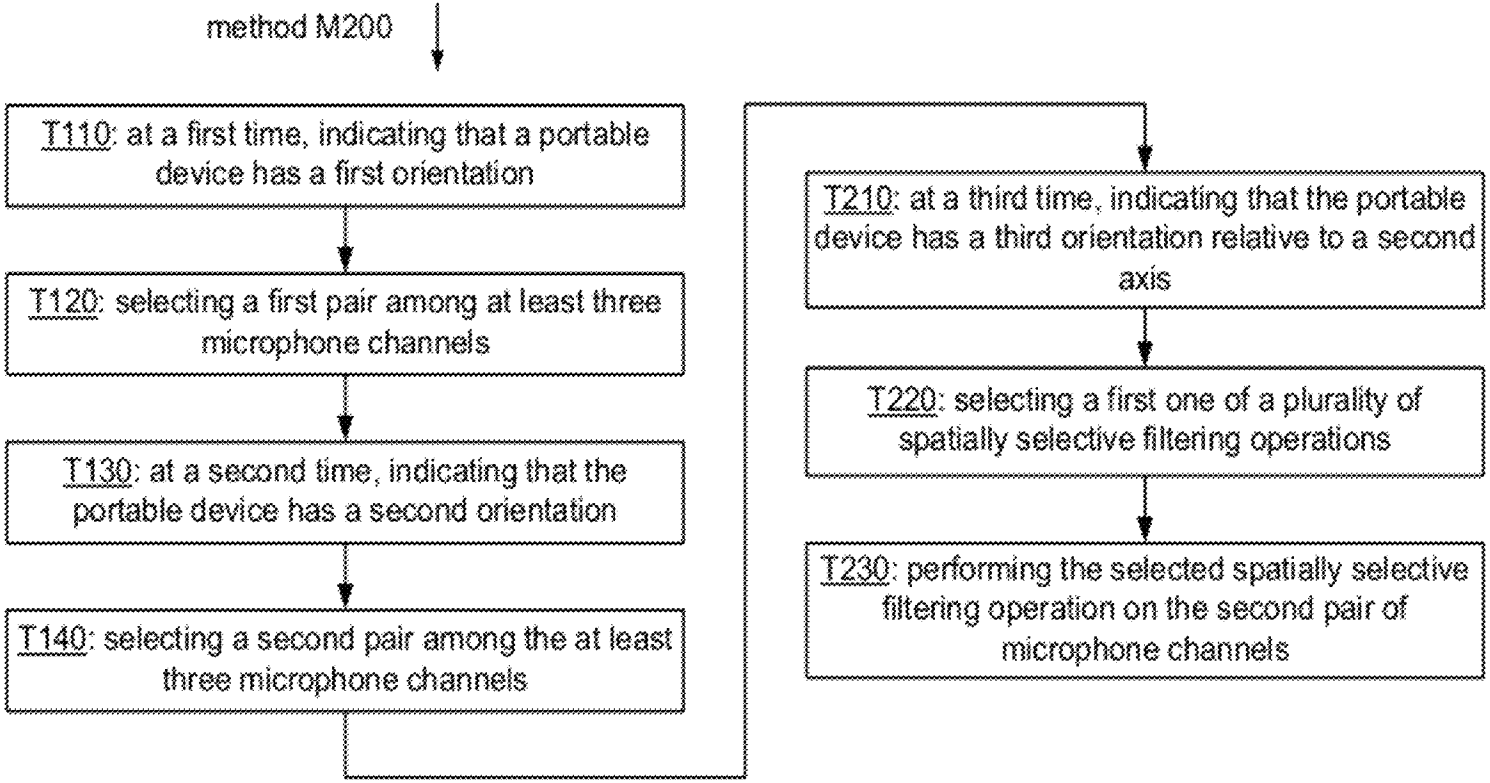
FIG. 12 shows a flowchart of an implementation M200 of method M100.

FIG. 12 shows a flowchart of an implementation M200 of method M100 that includes tasks T210, T220, and T230. At a third time that is different than the first time, task T210 indicates that the portable device has a third orientation relative to a second axis that is orthogonal to the gravitational axis (e.g., a magnetic axis). Based on this indication, task T220 selects a first one of a plurality of spatially selective filtering operations (e.g., selects one among a set of beam patterns). Task T230 performs the selected spatially selective filtering operation on the second pair of microphone channels (e.g., applies the selected beam pattern to the channel pair).

Figure 13:
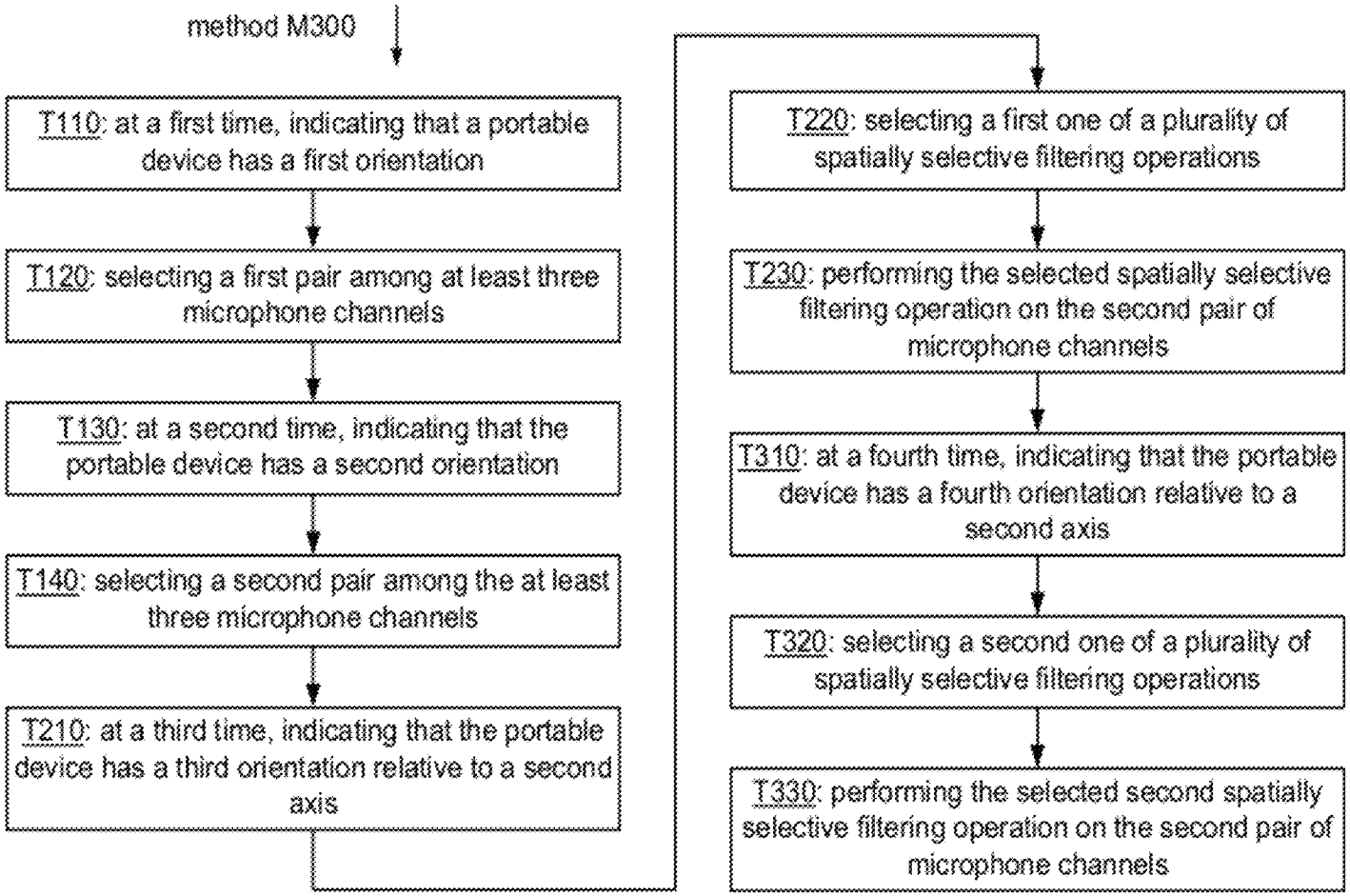
FIG. 13 shows a flowchart of an implementation M300 of method M200.

FIG. 13 shows a flowchart of an implementation M300 of method M200 that includes tasks T310, T320, and T330. At a fourth time that is different than the third time, task T310 indicates that the portable device has a fourth orientation relative to the second axis that is different than the third orientation. Based on this indication, task T320 selects a second one of the plurality of spatially selective filtering operations. Task T330 performs the selected second spatially selective filtering operation on the second pair of microphone channels.

Figure 14A:
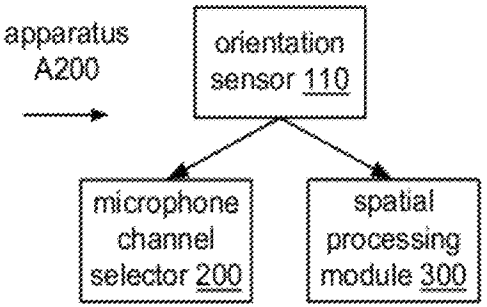
FIG. 14A shows a block diagram of an implementation A200 of apparatus A100.

FIG. 14A shows a block diagram of an implementation A200 of apparatus A100. Apparatus A200 includes an implementation 110 of orientation sensor 100 that is configured to indicate an orientation of the portable device relative to a second axis that is orthogonal to the gravitational axis (e.g., a magnetic axis). For example, orientation sensor 100 may be configured to indicate rotation of the device about the gravitational axis. Apparatus A200 also includes a spatial processing module 300 that is configured to select one of a set of spatially selective filters (e.g., beam patterns), based on the indication of the orientation relative to the second axis, and to apply the selected filter to the microphone channels selected by microphone channel selector 200. For example, spatial processing module 300 may be implemented as a selectable beamformer (e.g., to select among two or more pre-calculated stored beam patterns).

Spatial processing module 300 may be configured to select a beam pattern based on the orientation indication and on at least one specified direction (e.g., the direction of a desired source and/or the direction of an interfering source). Spatial processing module 300 may also be configured to store a reference orientation (e.g., indicating an orientation of the portable device relative to the second axis at a time when the direction was specified). In such case, spatial processing module 300 may be configured to calculate a difference between the indicated orientation and the reference orientation, to subtract this difference from the specified direction to obtain a target direction, and to select a beam pattern that is directed toward the target direction, given the indicated orientation.

Figure 14B:
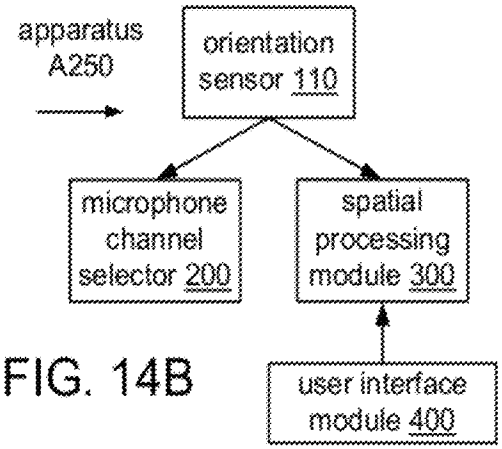
FIG. 14B shows a block diagram of an implementation A250 of apparatus A200.
Figure 14C:
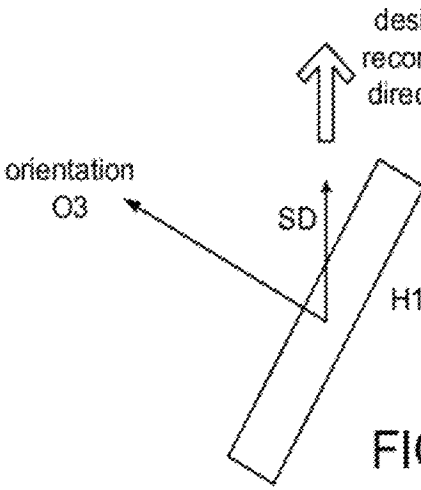
FIGS. 14C and 14D show an example of a direction calculation operation.
Figure 14D:
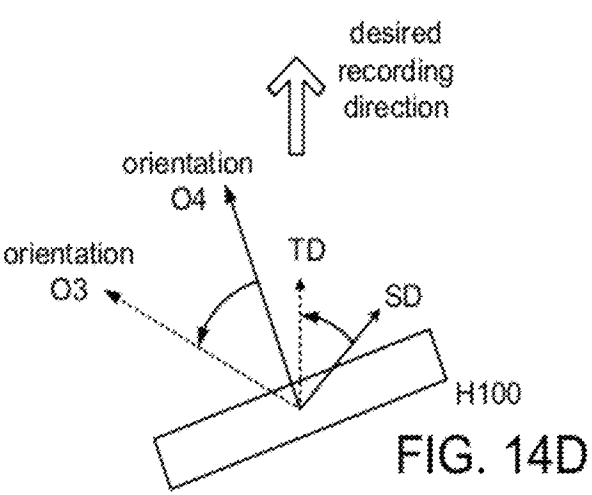

FIGS. 14C and 14D show an example of such an operation, where SD denotes a specified direction (e.g., as indicated by the user of the device at the time of FIG. 14C), TD denotes the target direction, and the views are from above (e.g., along the gravitational axis). Orientation O3 is the orientation of the device when direction SD is specified, and orientation O4 is the orientation of the device after a rotation about the gravitational axis. (Although orientations O3 and O4 are characterized in this example as the direction currently normal to the display surface of the device, it is expressly noted that this example is non-limiting, and that other directional characteristics of the device which are unaffected by the movement at issue may also be used to characterize device orientation.) In order to maintain selectivity in the desired recording direction at the time of FIG. 14D, spatial processing module 300 may be configured to select a beam pattern that is directed toward the target direction TD.

Figure 23B:
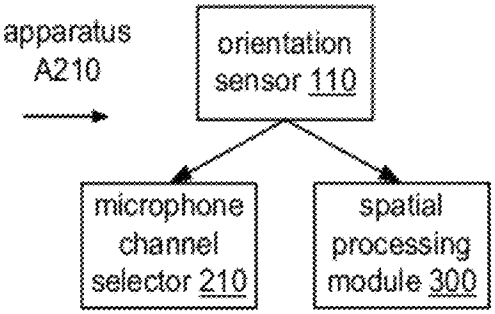
FIG. 23B shows a block diagram of an implementation A210 of apparatus A200.
Figure 23A:
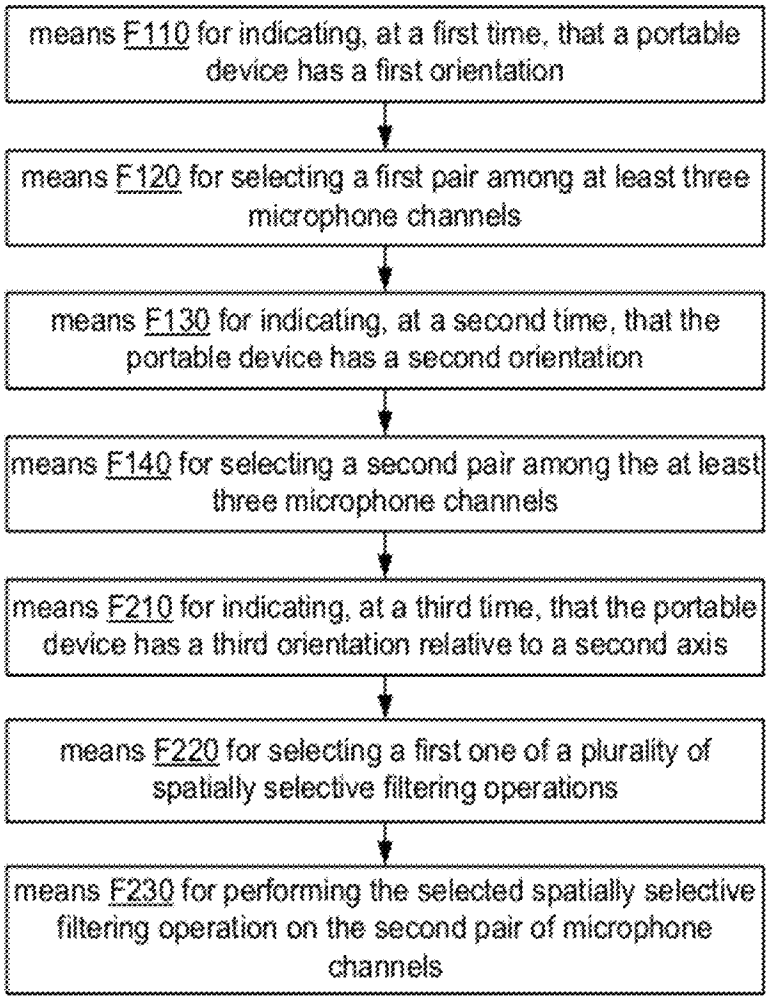
FIG. 23A shows a block diagram of an implementation MF200 of apparatus MF100.

FIG. 23A shows a block diagram of an implementation MF200 of apparatus MF100. Apparatus MF200 includes means F210 for indicating, at a third time that is different than the first time, that the portable device has a third orientation relative to a second axis that is orthogonal to the gravitational axis (e.g., as described herein with reference to task T210). Apparatus MF200 also includes means F220 for selecting a first one of a plurality of spatially selective filtering operations, based on this indication (e.g., as described herein with reference to task T220). Apparatus MF200 also includes means F230 for performing the selected spatially selective filtering operation on the second pair of microphone channels (e.g., as described herein with reference to task T230). FIG. 23B shows a block diagram of an implementation A210 of apparatus A200 that includes an instance of microphone channel selector 210.

FIG. 15B shows a block diagram of an apparatus A300 according to a general configuration that includes orientation sensor 110 and spatial processing module 300. In this case, orientation sensor 110 is configured to indicate an orientation of the portable device relative to the second axis (e.g., to indicate rotation of the device about the gravitational axis), and spatial processing module 300 is configured to select one of a set of spatially selective filters, based on the indication of the orientation relative to the second axis, and to apply the selected filter to a pair of microphone channels.

Figure 10B:
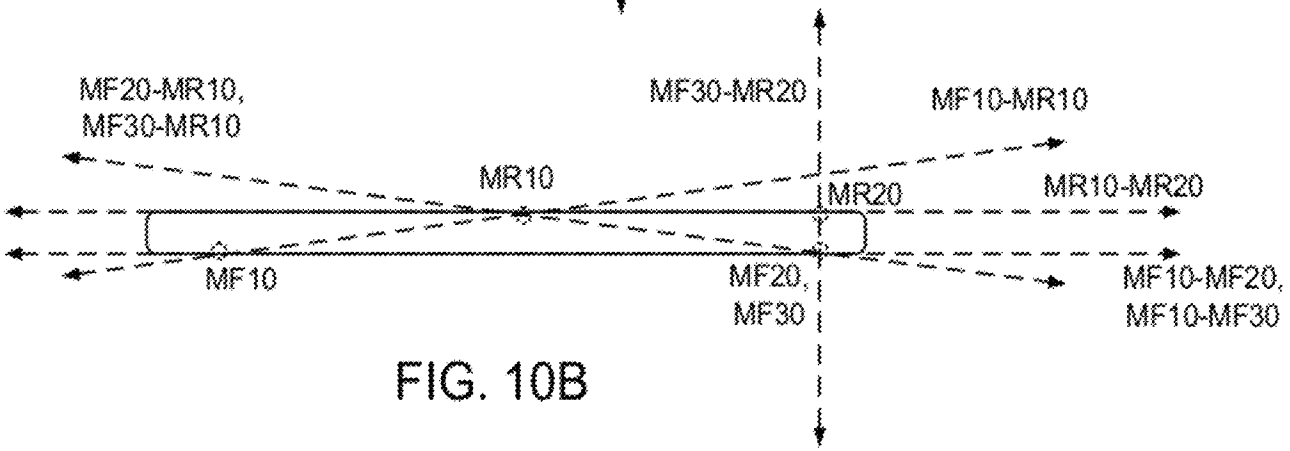
FIG. 10B shows examples of seven different microphone pairs of handset H100 that may be used in a landscape holding position.

It may also be desirable to select a different microphone pair in response to a rotation around the gravitational axis. FIG. 9B shows examples of four different microphone pairs (MF30-MR20, MF10-MR10, MF20-MR10, and MF20-MF30) that may be used in a portrait holding position to provide recording that is spatially selective in a plane which is horizontal to the gravitational axis. FIG. 10B shows examples of seven different microphone pairs (MF20-MR10, MF30-MR10, MF30-MR20, MF10-MR10, MR10-MR20, MF10-MF20, and MF10-MF30) that may be used in a landscape holding position to provide recording that is spatially selective in a plane which is horizontal to the gravitational axis. In either holding position, selection among the corresponding microphone pairs may be performed according to the current orientation of the device about the gravitational axis. For example, it may be desirable to select a pair having an endfire direction that is closest to the desired direction for recording, a pair having an endfire direction that is closest to the desired direction for suppression, or a pair whose endfire directions are closest to both such constraints. Alternatively or additionally, it may be desirable to select a different microphone pair in response to a tilt of the device.

FIG. 15A shows a flowchart of such an implementation M400 of method M100 that includes tasks T210 and T410. At a third time that is different than the first time, task T210 indicates that the portable device has a third orientation relative to a second axis that is orthogonal to the gravitational axis (e.g., a magnetic axis). Based on this indication, task T410 selects a third pair among the at least three microphone channels of the portable device that is different than the first pair and the second pair.

It is possible that a user's hand may occlude one or more of microphones corresponding to the selected pair and adversely affect a desired spatial response. It may be desirable to configure the recording operation to detect such failure of separation (e.g., by detecting a reduction in the filtered output and/or by comparing the output of the selected beam pattern to the output of another beam pattern in a similar direction) and to select a different pair in response to such detecting. Alternatively, it may be desirable to configure the recording operation to select a different beam pattern in response to such detecting.

Figure 16:
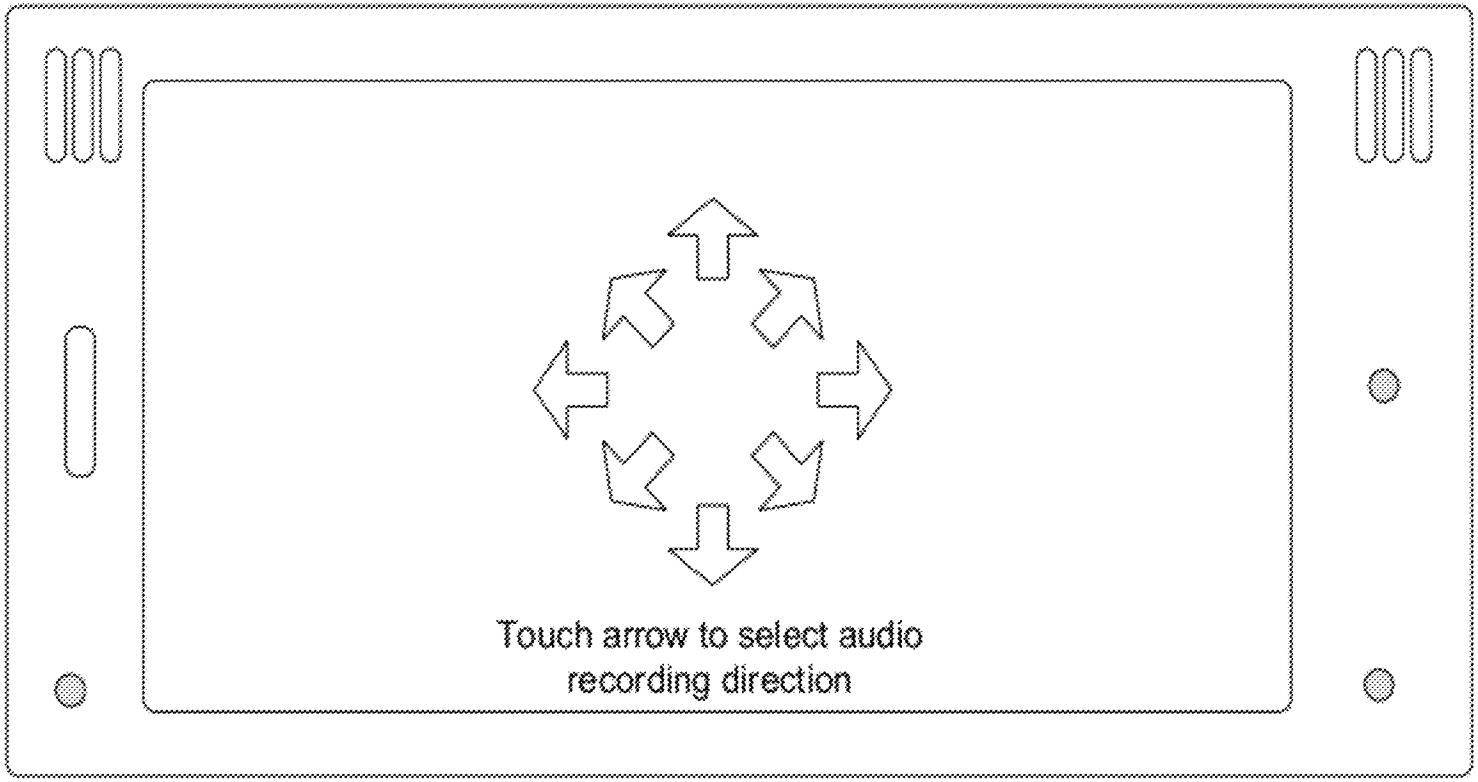
FIG. 16 shows one example of a selection display.

A user interface may be configured to support selection of a desired audio recording direction in a horizontal plane (e.g., two-dimensional selection), and the device may be configured to maintain this recording direction through rotation about the gravitational axis (i.e., an axis that is normal to the earth's surface). FIG. 16 shows one example of a selection display that may be generated by a user interface module and displayed on a display screen of the device (e.g., on touchscreen TS10 of handset H100) to prompt the user to specify a recording direction. In this example, the user selects an icon that corresponds to a desired recording direction, and the user interface module records an indication of the selected direction. FIG. 14B shows a block diagram of an implementation A250 of apparatus A200 that includes such a user interface module 400, and FIG. 15C shows a block diagram of an implementation A350 of apparatus A300 that includes an instance of a user interface module 400.

Figure 17:
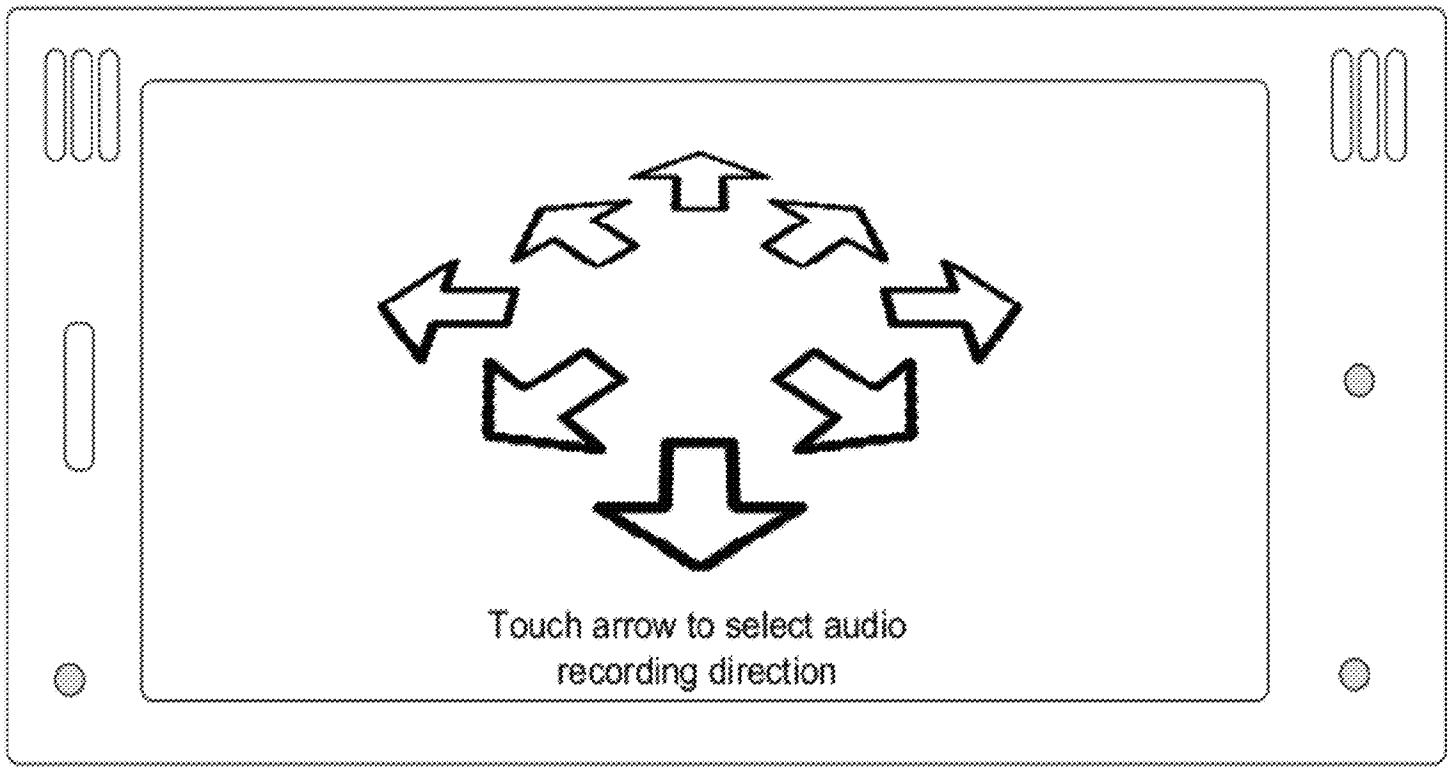
FIG. 17 shows another example of a selection display.

As noted above, it may also be desirable to record an indication of the orientation of the device (e.g., in a plane orthogonal to the gravitational axis) at the time the selection is made. For example, such an indication may be recorded as an angle with respect to a magnetic axis. Selection of a direction of an interfering source for spatially selective suppression may be performed in a similar manner. It may also be desirable for the user interface module to emphasize that a direction being selected is a direction in a horizontal plane by warping the selection display according to the current inclination of the device with respect to a horizontal plane (e.g., a plane normal to the gravitational axis), as shown in FIG. 17. Although the displays shown in FIGS. 16 and 17 may be used for two-dimensional selection (e.g., selection of a direction in a horizontal plane), selection of desired and/or interfering directions in three dimensions is also contemplated and hereby disclosed.

Figure 18:
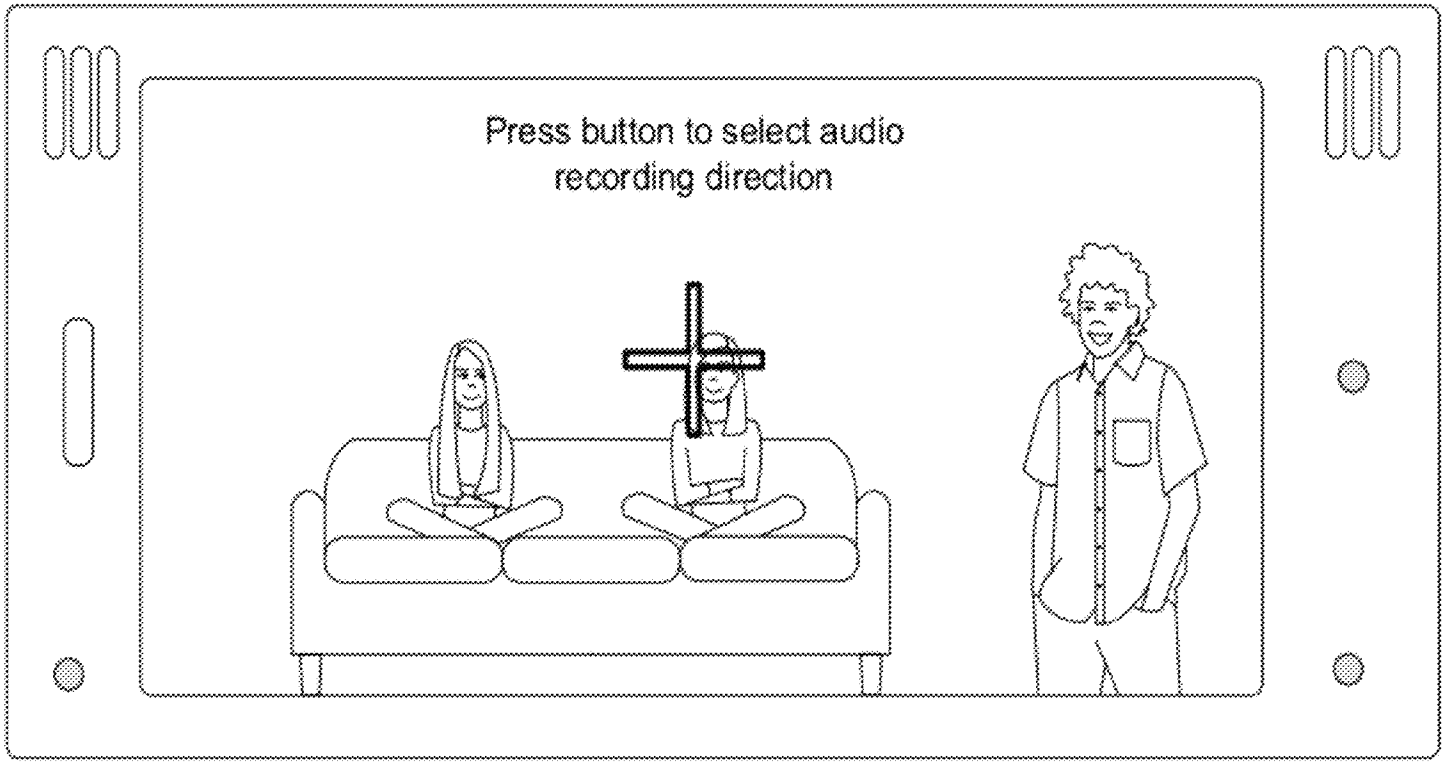
FIG. 18 shows one example of an overlay selection display.

For either two-dimensional (e.g., horizontal) or three-dimensional selection, the user interface may be configured for point-and-click selection. For example, during display on touchscreen TS10 of a video sequence currently being captured via lens L10, the user interface module may implement the selection display as an overlay to prompt the user to move the device to place a target (e.g., a cross or colored dot) on the desired source or at the desired direction, and to click a button switch or touch a selection point on the display when the target is placed appropriately to indicate selection of that direction. FIG. 18 shows one example of such an overlay selection display. The selection display shown in FIG. 17 may be similarly implemented as an overlay display.

Figure 19B:
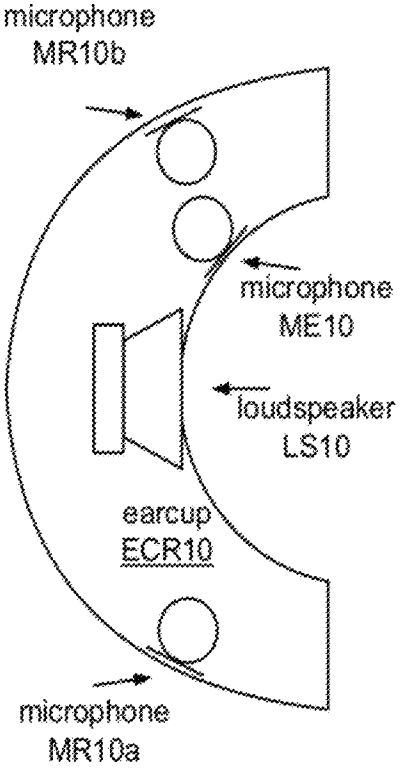
FIG. 19B shows a horizontal cross-section of earcup ECR10.
Figure 19A:
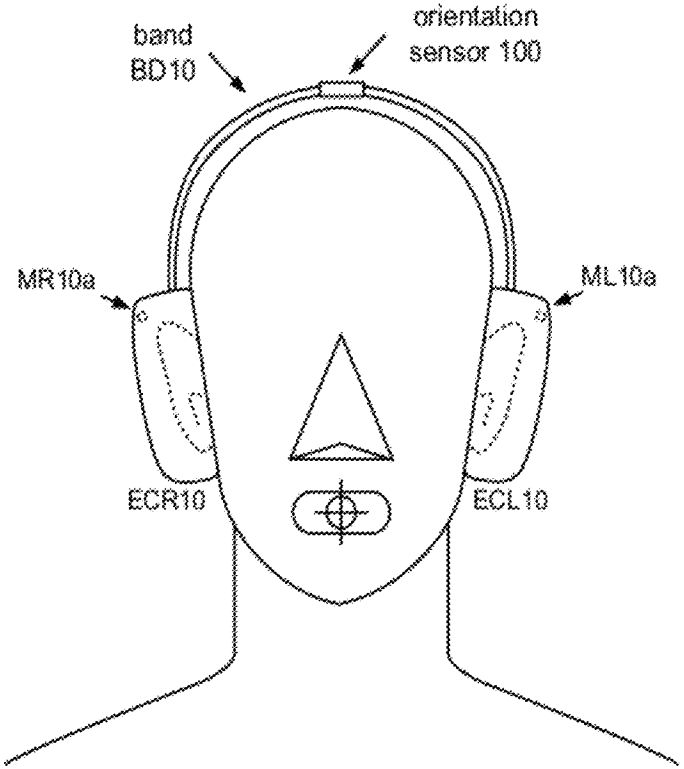
FIG. 19A shows a set of headphones.

The principles of orientation-sensitive recording as described herein may also be extended to recording applications using head-mounted microphones. In such case, it may be desirable to perform orientation tracking using one or more head-mounted implementations of orientation sensor 100. FIG. 19A shows an example in which orientation sensor 100 is mounted in a headband BD10 that connects the left and right earcups ECL10 and ECR10, respectively, of a set of headphones. FIG. 19B shows a horizontal cross-section of earcup ECR10 in which a front microphone MR10*a* and a rear microphone MR10*b* are disposed along a curved portion of the earcup housing. Earcup ECR10 also includes a loudspeaker LS10 that is arranged to produce an acoustic signal to the user's ear (e.g., from a signal received wirelessly or via a cord to a media playback or streaming device) and an error microphone ME10 that may be used to support active noise cancellation. It may be desirable to insulate the microphones from receiving mechanical vibrations from the loudspeaker through the structure of the earcup. Earcup ECR10 may be configured to be supra-aural (i.e., to rest over the user's ear during use without enclosing it) or circumaural (i.e., to enclose the user's ear during use). It will be understood that a left-side instance ECL10 of earcup ECR10 may be configured analogously. A method of orientation-sensitive recording as described herein may be performed by a processor mounted within the set of headphones (e.g., within the housing of earcup ECR10) or in a device configured to receive information from microphones MR10*a* and MR10*b* wirelessly or via a cord. For example, such a processor or device may be implemented to include the elements of apparatus A100, A200 or A300 other than the orientation sensor.

Figure 20:
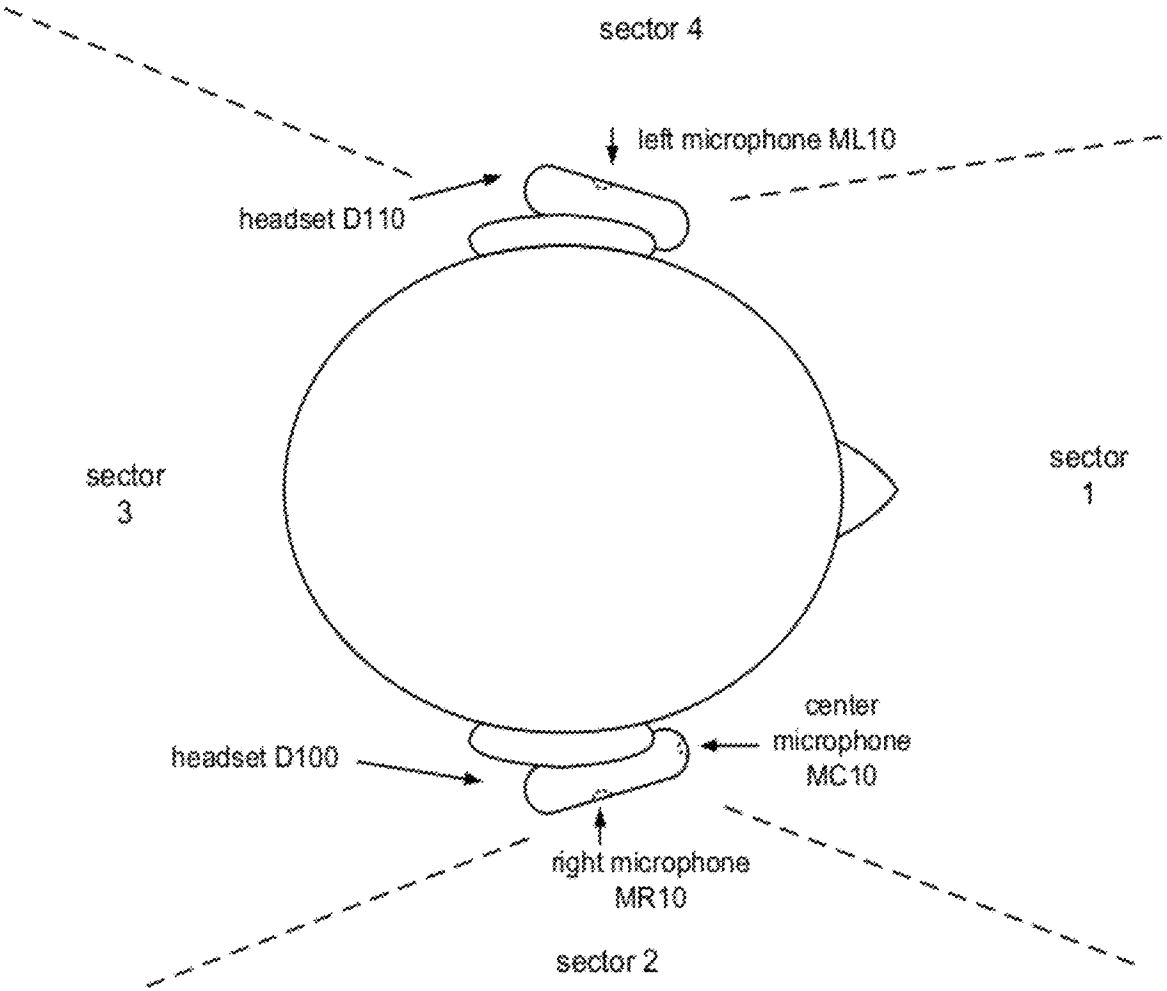
FIG. 20 shows an illustration of a related use case for a stereo headset.

FIG. 20 shows an illustration of a related use case for a stereo headset (e.g., a Bluetooth™ headset) that includes three microphones to support applications such as voice capture and/or active noise cancellation (ANC). Headset D100 includes a center microphone MC10 and one of microphones ML10 and MR10 and is worn at one of the user's ears, and headset D100 includes the other one of microphones ML10 and MR10 and is worn at the user's other ear. For such an application, different sectors around the head can be defined for recording using such a three-microphone configuration (e.g., as shown in FIG. 20, using omnidirectional microphones). For orientation-sensitive recording as described herein, an instance of orientation sensor 100 may be implemented within either or both of headsets D100 and D110, and such a method may be performed by a processor mounted within the housing of one of the headsets or in a device that is configured to receive information from microphones MC10, ML10, and MR10 wirelessly or via a cord.

Figure 21A:
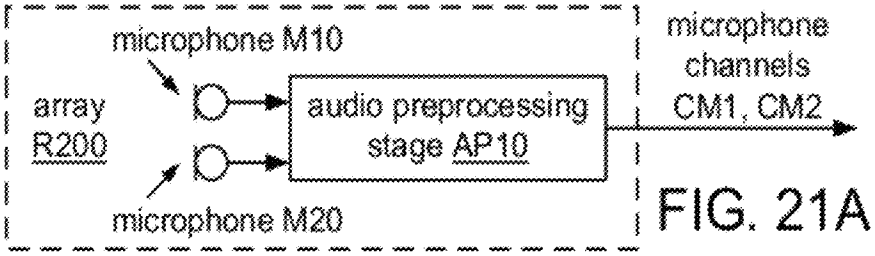
FIG. 21A shows a block diagram of an implementation R200 of array R100.

It may be desirable for array R100 to perform one or more processing operations on the signals produced by the microphones to produce the microphone channels to be selected (e.g., by microphone channel selector 200). FIG. 21A shows a block diagram of an implementation R200 of array R100 that includes an audio preprocessing stage AP10 configured to perform one or more such operations, which may include (without limitation) impedance matching, analog-to-digital conversion, gain control, and/or filtering in the analog and/or digital domains to produce microphone channels in which each channel is based on a response of the corresponding microphone to an acoustic signal.

Figure 21B:
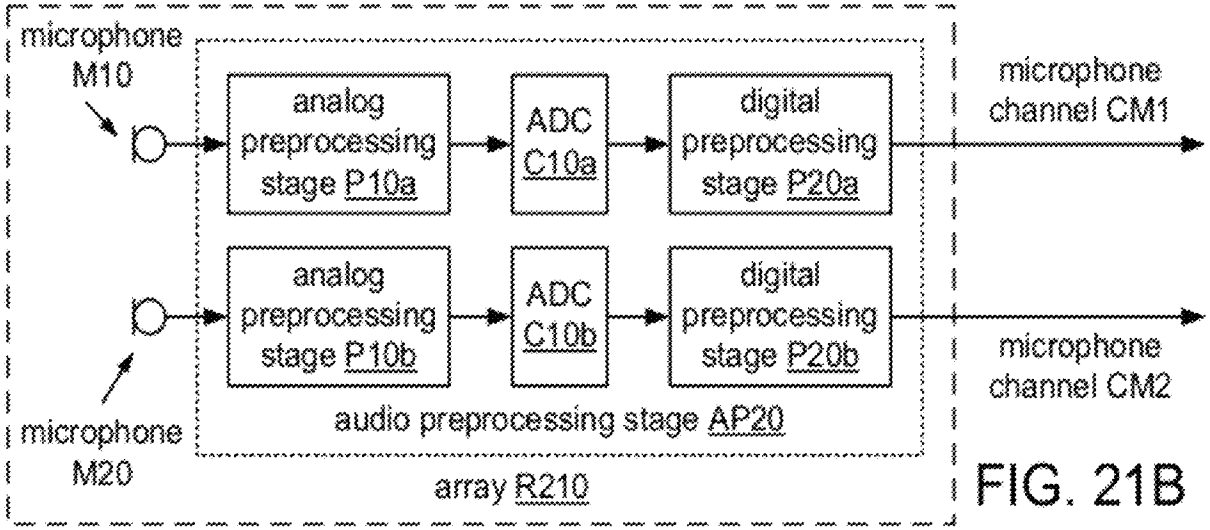
FIG. 21B shows a block diagram of an implementation R210 of array R200.

FIG. 21B shows a block diagram of an implementation R210 of array R200. Array R210 includes an implementation AP20 of audio preprocessing stage AP10 that includes analog preprocessing stages P10*a* and P10*b*. In one example, stages P10*a* and P10*b* are each configured to perform a highpass filtering operation (e.g., with a cutoff frequency of 50, 100, or 200 Hz) on the corresponding microphone signal.

It may be desirable for array R100 to produce each microphone channel as a digital signal, that is to say, as a sequence of samples. Array R210, for example, includes analog-to-digital converters (ADCs) C10*a* and C10*b* that are each arranged to sample the corresponding analog channel. Typical sampling rates for acoustic applications include 8 kHz, 12 kHz, 16 kHz, and other frequencies in the range of from about 8 to about 16 kHz, although sampling rates as high as about 44.1, 48, and 192 kHz may also be used. In this particular example, array R210 also includes digital preprocessing stages P20*a* and P20*b* that are each configured to perform one or more preprocessing operations (e.g., echo cancellation, noise reduction, and/or spectral shaping) on the corresponding digitized channel to produce the corresponding microphone channels CM1, CM2. Additionally or in the alternative, digital preprocessing stages P20*a* and P20*b* may be implemented to perform a frequency transform (e.g., an FFT or MDCT operation) on the corresponding digitized channel to produce the corresponding microphone channels CM1, CM2 in the corresponding frequency domain. Although FIGS. 21A and 21B show two-channel implementations, it will be understood that the same principles may be extended to an arbitrary number of microphones and corresponding microphone channels (e.g., a three-, four-, or five-channel implementation of array R100 as described herein). It is also expressly noted that some or all of the processing elements of array R100 may be implemented within apparatus A100, MF100, or A300 (e.g., downstream of microphone channel selector 200, such as within spatial processing module 300).

Each microphone of array R100 may have a response that is omnidirectional, bidirectional, or unidirectional (e.g., cardioid). The various types of microphones that may be used in array R100 include (without limitation) piezoelectric microphones, dynamic microphones, and electret microphones. In a device for portable voice communications, such as a handset or headset, the center-to-center spacing between adjacent microphones of array R100 is typically in the range of from about 1.5 cm to about 4.5 cm, although a larger spacing (e.g., up to 10 or 15 cm) is also possible in a device such as a handset or smartphone, and even larger spacings (e.g., up to 20, 25 or 30 cm or more) are possible in a device such as a tablet computer. For a far-field application, the center-to-center spacing between adjacent microphones of array R100 is typically in the range of from about four to ten centimeters, although a larger spacing between at least some of the adjacent microphone pairs (e.g., up to 20, 30, or 40 centimeters or more) is also possible in a device such as a flat-panel television display. The microphones of array R100 may be arranged along a line (with uniform or non-uniform microphone spacing) or, alternatively, such that their centers lie at the vertices of a two-dimensional (e.g., triangular) or three-dimensional shape.

The teachings herein with reference to array R100 may be applied to any combination of microphones of the portable device. For example, any two or more (and possibly all) of the microphones of a device as described herein may be used as an implementation of array R100.

It is expressly noted that the microphones may be implemented more generally as transducers sensitive to radiations or emissions other than sound. In one such example, the microphone pair is implemented as a pair of ultrasonic transducers (e.g., transducers sensitive to acoustic frequencies greater than fifteen, twenty, twenty-five, thirty, forty, or fifty kilohertz or more).

It may be desirable to perform a method as described herein within a portable audio sensing device that has an array R100 of two or more microphones configured to receive acoustic signals. Examples of a portable audio sensing device that may be implemented to include such an array and may be used to perform such a method for audio recording and/or voice communications applications include a telephone handset (e.g., a cellular telephone handset); a wired or wireless headset (e.g., a Bluetooth headset); a handheld audio and/or video recorder; a personal media player configured to record audio and/or video content; a personal digital assistant (PDA) or other handheld computing device; and a notebook computer, laptop computer, netbook computer, tablet computer, or other portable computing device. The class of portable computing devices currently includes devices having names such as laptop computers, notebook computers, netbook computers, ultra-portable computers, tablet computers, mobile Internet devices, smartbooks, and smartphones. Such a device may have a top panel that includes a display screen and a bottom panel that may include a keyboard, wherein the two panels may be connected in a clamshell or other hinged relationship. Such a device may be similarly implemented as a tablet computer that includes a touchscreen display on a top surface.

Figure 22A:
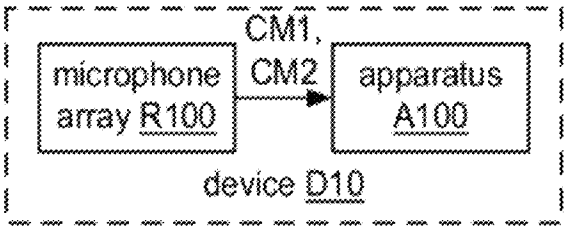
FIG. 22A shows a block diagram of a multimicrophone audio sensing device D10 according to a general configuration.

FIG. 22A shows a block diagram of a multimicrophone audio sensing device D10 according to a general configuration. Device D10 includes an instance of any of the implementations of microphone array R100 disclosed herein and an instance of any of the implementations of apparatus A100 or A300 (or MF100) disclosed herein, and any of the audio sensing devices disclosed herein may be implemented as an instance of device D10. Apparatus A100 may be implemented as a combination of hardware (e.g., a processor) with software and/or with firmware.

Figure 22B:
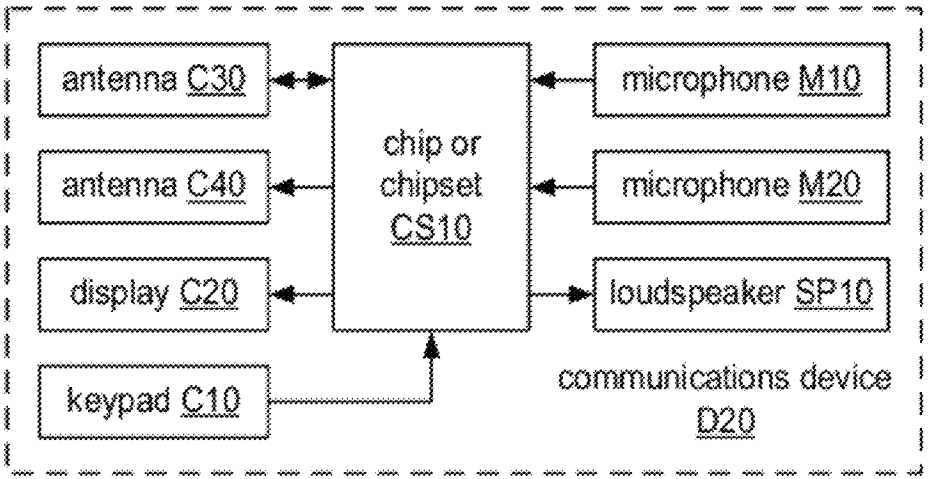
FIG. 22B shows a block diagram of a communications device D20 that is an implementation of device D10.

FIG. 22B shows a block diagram of a communications device D20 that is an implementation of device D10. Device D20 includes a chip or chipset CS10 (e.g., a mobile station modem (MSM) chipset) that includes an implementation of apparatus A100 (or MF100) as described herein. Chip/chipset CS10 may include one or more processors, which may be configured to execute all or part of the operations of apparatus A100 or MF100 (e.g., as instructions). Chip/chipset CS10 may also include processing elements of array R100 (e.g., elements of audio preprocessing stage AP10 as described below).

Chip/chipset CS10 includes a receiver which is configured to receive a radio-frequency (RF) communications signal (e.g., via antenna C40) and to decode and reproduce (e.g., via loudspeaker SP10) an audio signal encoded within the RF signal. Chip/chipset CS10 also includes a transmitter which is configured to encode an audio signal that is based on an output signal produced by apparatus A100 (e.g., the spatially selectively filtered signal) and to transmit an RF communications signal (e.g., via antenna C40) that describes the encoded audio signal. For example, one or more processors of chip/chipset CS10 may be configured to perform a noise reduction operation (e.g., Wiener filtering or spectral subtraction, using a noise reference as described above) on one or more channels of the output signal such that the encoded audio signal is based on the noise-reduced signal. In this example, device D20 also includes a keypad C10 and display C20 to support user control and interaction. It is expressly disclosed that applicability of systems, methods, and apparatus disclosed herein is not limited to the particular examples noted herein.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, or 44 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

The various elements of an implementation of an apparatus as disclosed herein (e.g., apparatus A100, A200, A300, and MF100) may be embodied in any combination of hardware with software, and/or with firmware, that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to an orientation-sensitive recording procedure, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer storage media and communication media, including any medium that facilitates transfer of a computer program from one place to another. A storage media may be any available media that can be accessed by a computer. By way of example, and not limitation, such computer-readable media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage, magnetic disk storage or other magnetic storage devices, or any other medium that can be used to store desired program code, in the form of instructions or data structures, in tangible structures that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of orientation-sensitive recording control, said method comprising:

within a portable device, and at a first time, indicating that the portable device has a first orientation relative to a gravitational axis;

based on said indication that the portable device has the first orientation, selecting a first pair among at least three microphone channels of the portable device;

within the portable device, and at a second time that is subsequent to the first time, indicating that the portable device has a second orientation relative to the gravitational axis that is different than the first orientation;

based on said indication that the portable device has the second orientation, selecting a second pair among the at least three microphone channels that is different than the first pair;

within the portable device, and at a third time subsequent to the first time, indicating that the portable device has a third orientation relative to a second axis that is orthogonal to the gravitational axis;

based on said indication that the portable device has the third orientation, selecting a first one of a plurality of spatially selective filtering operations; and performing the selected spatially selective filtering operation on the second pair of microphone channels, wherein each of the at least three microphone channels is based on a signal produced by a corresponding one of at least three microphones of the portable device.

2. The method according to claim 1, wherein the first pair of microphone channels includes a first microphone channel, and wherein the second pair of microphone channels includes the first microphone channel.

3. The method according to claim 1, wherein said indicating that the portable device has the second orientation includes detecting a rotation of the portable device about a line that is orthogonal to the gravitational axis.

4. The method according to claim 1, wherein said indicating that the portable device has the second orientation includes detecting a rotation of the portable device by at least forty-five degrees about a line that is orthogonal to the gravitational axis.

5. The method according to claim 1, wherein said method includes, during a time interval that includes the first and second times, recording a video sequence of images that are based on a signal produced by an imaging sensor of the portable device.

6. The method according to claim 1, wherein said selecting the first one of the plurality of spatially selective filtering operations is based on a specified direction in a plane that is orthogonal to the gravitational axis.

7. The method according to claim 1, wherein said indicating that the portable device has the third orientation is performed in response to an indication that a user of the device has selected a direction for recording.

8. The method according to claim 1, wherein said method comprises:

at a fourth time subsequent to the third time, indicating that the portable device has a fourth orientation relative to the second axis; and based on said indication that the portable device has the fourth orientation, selecting a second one of the plurality of spatially selective filtering operations; and performing the selected second spatially selective filtering operation on the second pair of microphone channels.

9. The method according to claim 8, wherein said indicating that the portable device has the fourth orientation includes detecting a rotation of the portable device about the gravitational axis.

10. The method according to claim 8, wherein said selecting a second one of the plurality of spatially selective filtering operations is based on a relation between the third and fourth orientations.

11. The method according to claim 10, wherein said relation is an angle in a plane orthogonal to the gravitational axis.

12. The method according to claim 8, wherein said performing the selected spatially selective filtering operation comprises applying a beam pattern having a first direction relative to the portable device to the second pair of microphone channels, and wherein said performing the selected second spatially selective filtering operation comprises applying a beam pattern having a second direction relative to the portable device to the second pair of microphone channels, wherein the second direction is at least thirty degrees different from the first direction.

13. A method of orientation-sensitive recording control, said method comprising:

within a portable device, and at a first time, indicating that the portable device has a first orientation relative to a gravitational axis;

based on said indication that the portable device has the first orientation, selecting a first pair among at least three microphone channels of the portable device;

within the portable device, and at a second time that is subsequent to the first time, indicating that the portable device has a second orientation relative to the gravitational axis that is different than the first orientation;

based on said indication that the portable device has the second orientation, selecting a second pair among the at least three microphone channels that is different than the first pair;

within the portable device, and at a third time subsequent to the second time, indicating that the portable device has a third orientation relative to a second axis that is orthogonal to the gravitational axis; and based on said indication that the portable device has the third orientation, selecting a third pair among the at least three microphone channels of the portable device that is different than the first pair and the second pair, wherein each of the at least three microphone channels is based on a signal produced by a corresponding one of at least three microphones of the portable device.

14. An apparatus for orientation-sensitive recording control, said apparatus comprising:

means for indicating, at a first time, that a portable device has a first orientation relative to a gravitational axis;

means for selecting a first pair among at least three microphone channels of the portable device, based on said indication that the portable device has the first orientation;

means for indicating, at a second time that is different than the first time, that the portable device has a second orientation relative to the gravitational axis that is different than the first orientation;

means for selecting a second pair among the at least three microphone channels that is different than the first pair, based on said indication that the portable device has the second orientation;

means for indicating, at a third time subsequent to the first time, that the portable device has a third orientation relative to a second axis that is orthogonal to the gravitational axis;

means for selecting a first one of a plurality of spatially selective filters, based on said indication that the portable device has the third orientation; and means for applying the selected spatially selective filter to the second pair of microphone channels, wherein each of the at least three microphone channels is based on a signal produced by a corresponding one of at least three microphones of the portable device.

15. The apparatus according to claim 14, wherein the first pair of microphone channels includes a first microphone channel, and wherein the second pair of microphone channels includes the first microphone channel.

16. The apparatus according to claim 14, wherein said means for indicating that the portable device has a second orientation is configured to indicate that the portable device has the second orientation by detecting a rotation of the portable device about a line that is orthogonal to the gravitational axis.

17. The apparatus according to claim 14, wherein said means for indicating that the portable device has a second orientation is configured to indicate that the portable device has the second orientation by detecting a rotation of the portable device by at least forty-five degrees about a line that is orthogonal to the gravitational axis.

18. The apparatus according to claim 14, wherein said apparatus includes means for recording, during a time interval that includes the first and second times, a video sequence of images that are based on a signal produced by an imaging sensor of the portable device.

19. The apparatus according to claim 14, wherein said means for selecting a first one of a plurality of spatially selective filters is configured to select the first one of the plurality of spatially selective filters based on a specified direction in a plane that is orthogonal to the gravitational axis.

20. The apparatus according to claim 14, wherein said means for selecting a first one of a plurality of spatially selective filters is configured to store a reference orientation in response to an indication that a user of the device has selected a direction for recording, and wherein said reference orientation is based on said indication that the portable device has a third orientation.

21. The apparatus according to claim 14, wherein said apparatus includes:

means for indicating, at a fourth time subsequent to the third time, that the portable device has a fourth orientation relative to the second axis;

means for selecting a second one of the plurality of spatially selective filters, based on said indication that the portable device has the fourth orientation; and means for applying the selected second spatially selective filter to the second pair of microphone channels.

22. The apparatus according to claim 21, wherein said means for indicating that the portable device has the fourth orientation is configured to indicate that the portable device has the fourth orientation by detecting a rotation of the portable device about the gravitational axis.

23. The apparatus according to claim 21, wherein said means for selecting a second one of the plurality of spatially selective filters is configured to select the second one of the plurality of spatially selective filters based on a relation between the third and fourth orientations.

24. The apparatus according to claim 23, wherein said relation is an angle in a plane orthogonal to the gravitational axis.

25. The apparatus according to claim 21, wherein a beam pattern of the selected spatially selective filter has a first direction relative to the portable device, and wherein a beam pattern of the selected second spatially selective filter has a second direction relative to the portable device, wherein the second direction is at least thirty degrees different from the first direction.

26. An apparatus for orientation-sensitive recording control, said apparatus comprising:

means for indicating, at a first time, that a portable device has a first orientation relative to a gravitational axis;

means for selecting a first pair among at least three microphone channels of the portable device, based on said indication that the portable device has the first orientation;

means for indicating, at a second time that is different than the first time, that the portable device has a second orientation relative to the gravitational axis that is different than the first orientation;

means for selecting a second pair among the at least three microphone channels that is different than the first pair, based on said indication that the portable device has the second orientation;

means for indicating, at a third time subsequent to the second time, that the portable device has a third orientation relative to a second axis that is orthogonal to the gravitational axis; and means for selecting a third pair among the at least three microphone channels of the portable device that is different than the first pair and the second pair, based on said indication that the portable device has the third orientation wherein each of the at least three microphone channels is based on a signal produced by a corresponding one of at least three microphones of the portable device.

27. An apparatus for orientation-sensitive recording control, said apparatus comprising:

an orientation sensor configured to indicate, at a first time, that a portable device has a first orientation relative to a gravitational axis; and a microphone channel selector configured to select a first pair among at least three microphone channels of the portable device, based on said indication that the portable device has the first orientation, wherein each of the at least three microphone channels is based on a signal produced by a corresponding one of at least three microphones of the portable device, and wherein said orientation sensor is configured to indicate, at a second time that is different than the first time, that the portable device has a second orientation relative to the gravitational axis that is different than the first orientation, wherein said microphone channel selector is configured to select a second pair among the at least three microphone channels that is different than the first pair, based on said indication that the portable device has the second orientation, wherein said orientation sensor is configured to indicate, at a third time subsequent to the first time, that the portable device has a third orientation relative to a second axis that is orthogonal to the gravitational axis, and wherein said apparatus includes a spatial processing module configured (A) to select a first one of a plurality of spatially selective filters based on said indication that the portable device has the third orientation, and (B) to apply the selected spatially selective filter to the second pair of microphone channels.

28. The apparatus according to claim 27, wherein the first pair of microphone channels includes a first microphone channel, and wherein the second pair of microphone channels includes the first microphone channel.

29. The apparatus according to claim 27, wherein said orientation sensor is configured to indicate that the portable device has the second orientation by detecting a rotation of the portable device about a line that is orthogonal to the gravitational axis.

30. The apparatus according to claim 27, wherein said orientation sensor is configured to indicate that the portable device has the second orientation by detecting a rotation of the portable device by at least forty-five degrees about a line that is orthogonal to the gravitational axis.

31. The apparatus according to claim 27, wherein said apparatus includes a video recording module configured to record, during a time interval that includes the first and second times, a video sequence of images that are based on a signal produced by an imaging sensor of the portable device.

32. The apparatus according to claim 27, wherein said spatial processing module is configured to select the first one of the plurality of spatially selective filters based on a specified direction in a plane that is orthogonal to the gravitational axis.

33. The apparatus according to claim 27, wherein said spatial processing module is configured to store a reference orientation in response to an indication that a user of the device has selected a direction for recording, and wherein said reference orientation is based on said indication that the portable device has a third orientation.

34. The apparatus according to claim 27, wherein said orientation sensor is configured to indicate, at a fourth time subsequent to the third time, that the portable device has a fourth orientation relative to the second axis, and wherein said spatial processing module is configured (A) to select a second one of the plurality of spatially selective filters, based on said indication that the portable device has the fourth orientation, and (B) to apply the selected second spatially selective filter to the second pair of microphone channels.

35. The apparatus according to claim 34, wherein said orientation sensor is configured to indicate that the portable device has the fourth orientation by detecting a rotation of the portable device about the gravitational axis.

36. The apparatus according to claim 34, wherein said spatial processing module is configured to select the second one of the plurality of spatially selective filters based on a relation between the third and fourth orientations.

37. The apparatus according to claim 36, wherein said relation is an angle in a plane orthogonal to the gravitational axis.

38. The apparatus according to claim 34, wherein a beam pattern of the selected spatially selective filter has a first direction relative to the portable device, and wherein a beam pattern of the selected second spatially selective filter has a second direction relative to the portable device, wherein the second direction is at least thirty degrees different from the first direction.

39. An apparatus for orientation-sensitive recording control, said apparatus comprising:

an orientation sensor configured to indicate, at a first time, that a portable device has a first orientation relative to a gravitational axis; and a microphone channel selector configured to select a first pair among at least three microphone channels of the portable device, based on said indication that the portable device has the first orientation, wherein each of the at least three microphone channels is based on a signal produced by a corresponding one of at least three microphones of the portable device, and wherein said orientation sensor is configured to indicate, at a second time that is different than the first time, that the portable device has a second orientation relative to the gravitational axis that is different than the first orientation, wherein said microphone channel selector is configured to select a second pair among the at least three microphone channels that is different than the first pair, based on said indication that the portable device has the second orientation, wherein said orientation sensor is configured to indicate, at a third time subsequent to the second time, that the portable device has a third orientation relative to a second axis that is orthogonal to the gravitational axis, and said spatial processing module is configured to select a third pair among the at least three microphone channels of the portable device that is different than the first pair and the second pair, based on said indication that the portable device has the third orientation.

40. A non-transitory machine-readable storage medium comprising tangible features that when read by a machine cause the machine to:

indicate, at a first time, that a portable device has a first orientation relative to a gravitational axis;

select a first pair among at least three microphone channels of the portable device, based on said indication that the portable device has the first orientation;

indicate, at a second time that is subsequent to the first time, that the portable device has a second orientation relative to the gravitational axis that is different than the first orientation;

select a second pair among the at least three microphone channels that is different than the first pair, based on said indication that the portable device has the second orientation, indicate, at a third time subsequent to the first time, that the portable device has a third orientation relative to a second axis that is orthogonal to the gravitational axis;

select a first one of a plurality of spatially selective filters, based on said indication that the portable device has the third orientation; and apply the selected spatially selective filter to the second pair of microphone channels, wherein each of the at least three microphone channels is based on a signal produced by a corresponding one of at least three microphones of the portable device.

41. A non-transitory machine-readable storage medium comprising tangible features that when read by a machine cause the machine to:

indicate, at a first time, that a portable device has a first orientation relative to a gravitational axis;

select a first pair among at least three microphone channels of the portable device, based on said indication that the portable device has the first orientation;

indicate, at a second time that is different than the first time, that the portable device has a second orientation relative to the gravitational axis that is different than the first orientation;

select a second pair among the at least three microphone channels that is different than the first pair, based on said indication that the portable device has the second orientation;

indicate, at a third time subsequent to the second time, that the portable device has a third orientation relative to a second axis that is orthogonal to the gravitational axis; and select a third pair among the at least three microphone channels of the portable device that is different than the first pair and the second pair, based on said indication that the portable device has the third orientation wherein each of the at least three microphone channels is based on a signal produced by a corresponding one of at least three microphones of the portable device.

* * * * *